US011047272B2

(12) United States Patent
Uezu

(10) Patent No.: US 11,047,272 B2
(45) Date of Patent: Jun. 29, 2021

(54) ENGINE LUBRICATION SYSTEM, ENGINE, AND VEHICLE

(71) Applicant: Yamaha Hatsudoki Kabushiki Kaisha, Shizuoka-ken (JP)

(72) Inventor: Junji Uezu, Shizuoka (JP)

(73) Assignee: YAMAHA HATSUDOKI KABUSHIKI KAISHA, Shizuoka-Ken (JP)

( * ) Notice: Subject to any disclaimer, the term of this patent is extended or adjusted under 35 U.S.C. 154(b) by 429 days.

(21) Appl. No.: 15/815,722

(22) Filed: Nov. 17, 2017

(65) Prior Publication Data

US 2018/0142586 A1 May 24, 2018

(30) Foreign Application Priority Data

Nov. 18, 2016 (JP) ..... JP2016-225036

(51) Int. Cl.
*F01M 1/12* (2006.01)
*F01M 1/02* (2006.01)
*F01M 11/02* (2006.01)

(52) U.S. Cl.
CPC ..... *F01M 1/12* (2013.01); *F01M 1/02* (2013.01); *F01M 11/02* (2013.01); *F01M 2001/123* (2013.01); *F01M 2001/126* (2013.01)

(58) Field of Classification Search
CPC ..... F01M 1/12; F01M 1/02; F01M 11/02
See application file for complete search history.

(56) References Cited

U.S. PATENT DOCUMENTS 5,101,936 A * 4/1992 Paredes ..... F01M 1/12 123/196 S
6,076,624 A * 6/2000 Izumi ..... F16D 41/06 180/291
7,267,094 B2 * 9/2007 Tawarada ..... F01M 11/02 123/196 CP
2009/0218169 A1 * 9/2009 Kawamura ..... F01M 1/04 184/6.5
2015/0128886 A1 * 5/2015 Ogino ..... F01M 11/02 123/54.4
2015/0377191 A1 * 12/2015 Uezu ..... F02M 35/0216 55/357
2018/0141425 A1 * 5/2018 Uezu ..... B60K 5/1283
2018/0142586 A1 * 5/2018 Uezu ..... F01M 1/12

FOREIGN PATENT DOCUMENTS

JP H10-297294 A 11/1998
JP 2009-203960 A 9/2009
JP 2010-188992 A 9/2010

* cited by examiner

*Primary Examiner* — Michael A Riegelman
(74) *Attorney, Agent, or Firm* — HEA Law PLLC

(57) ABSTRACT

An engine lubrication system including an oil passage allowing inflow of oil in a crank chamber partitioned off in a crankcase of an engine, at least a part of the oil passage being formed by the crankcase, a scavenge pump accommodated in the crankcase and sucking the oil from the oil passage, an oil tank accumulating the oil sucked by the scavenge pump, and a feed pump supplying, to the engine, the oil accumulated in the oil tank.

24 Claims, 16 Drawing Sheets

ENGINE LUBRICATION SYSTEM, ENGINE, AND VEHICLE

CROSS-REFERENCE TO RELATED APPLICATION

The present application claims priority from Japanese application JP2016-225036 filed on Nov. 18, 2016, the content of which is hereby incorporated by reference into this application.

FIELD OF THE INVENTION

The present application relates to an engine lubrication system, an engine, and a vehicle.

BACKGROUND OF THE INVENTION

As a lubricating system for an engine, a dry sump system has been known. Unlike a wet sump system, the dry sump system does not require a relatively large oil pan for accumulating oil. Thus, the dry sump system has an advantage of enabling downsizing of an engine.

In Japanese Patent Application Laid-open No. 2009-203960, there is described a multi-cylinder engine having such a configuration that pumps, which are smaller in number than crank chambers, are arranged outside an engine, and, among oil collection passages respectively formed for the crank chambers, the predetermined number of the oil collection passages are joined together and connected to at least one of the pumps. With this configuration, the oil is smoothly collected.

SUMMARY OF THE INVENTION

However, when the pumps are arranged outside the engine as described in Japanese Patent Application Laid-open No. 2009-203960, it is necessary to firmly form the pumps to protect the pumps from a flying object such as a stone, and to further prevent leakage of oil. In particular, a vehicle for use in rough terrain, such as a recreational off-highway vehicle (ROV), has a higher need to protect the pumps from a flying object such as a stone than a general automobile.

The present application has been made to solve the above-mentioned problem, and one object is to provide an engine lubrication system, an engine, and a vehicle, capable of protecting a pump while increasing an oil collection efficiency.

According to one embodiment disclosed in the present application, there is provided an engine lubrication system including an oil passage allowing inflow of oil in a crank chamber partitioned off in a crankcase of an engine, at least a part of the oil passage being formed by the crankcase, a scavenge pump accommodated in the crankcase and sucking the oil from the oil passage, an oil tank accumulating the oil sucked by the scavenge pump, and a feed pump supplying, to the engine, the oil accumulated in the oil tank.

Further, according to one embodiment disclosed in the present application, there is provided an engine including a crankcase, an oil passage allowing inflow of oil in a crank chamber partitioned off in the crankcase, at least a part of the oil passage being formed by the crankcase, and a scavenge pump accommodated in the crankcase, and sucking the oil from the oil passage to supply the oil into an oil tank.

Further, according to one embodiment disclosed in the present application, there is provided a vehicle including an engine including an oil passage allowing inflow of oil in a crank chamber partitioned off in a crankcase, at least a part of the oil passage formed by the crankcase, a scavenge pump sucking the oil from the oil passage, an oil tank arranged outside the engine and accumulating the oil sucked by the scavenge pump, a feed pump supplying, to the engine, the oil accumulated in the oil tank, and a plurality of seats aligned in a right-and-left direction of the vehicle. At least a part of the engine is located between the plurality of seats in plan view, and is located below the plurality of seats in side view.

According to the above-mentioned embodiment, the oil is sucked from the oil passage that allows inflow of the oil in the crank chamber. Thus, the oil collecting efficiency can be increased. Further, the scavenge pump is accommodated in the crankcase. Thus, the pump can be protected.

When the scavenge pump is accommodated in the crankcase, the oil passage can be reduced in length as compared to a case in which the scavenge pump is arranged outside the engine. Thus, suction resistance can be reduced, and the oil collection efficiency can be increased.

Other objects and features of this invention will be in part apparent and in part point pointed out hereinafter.

BRIEF DESCRIPTION OF THE DRAWINGS

The following drawings illustrate examples of various components of the invention disclosed herein, and are for illustrative purposes only.

DETAILED DESCRIPTION OF THE INVENTION

While the present invention may be embodied in many different forms, several illustrative embodiments are described herein with the understanding that this disclosure is to be considered as providing examples of the principles of the invention and such examples are not intended to limit the invention to the preferred embodiments described herein and/or illustrated herein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by referencing the appended figures representing embodiments.

Figure 1:
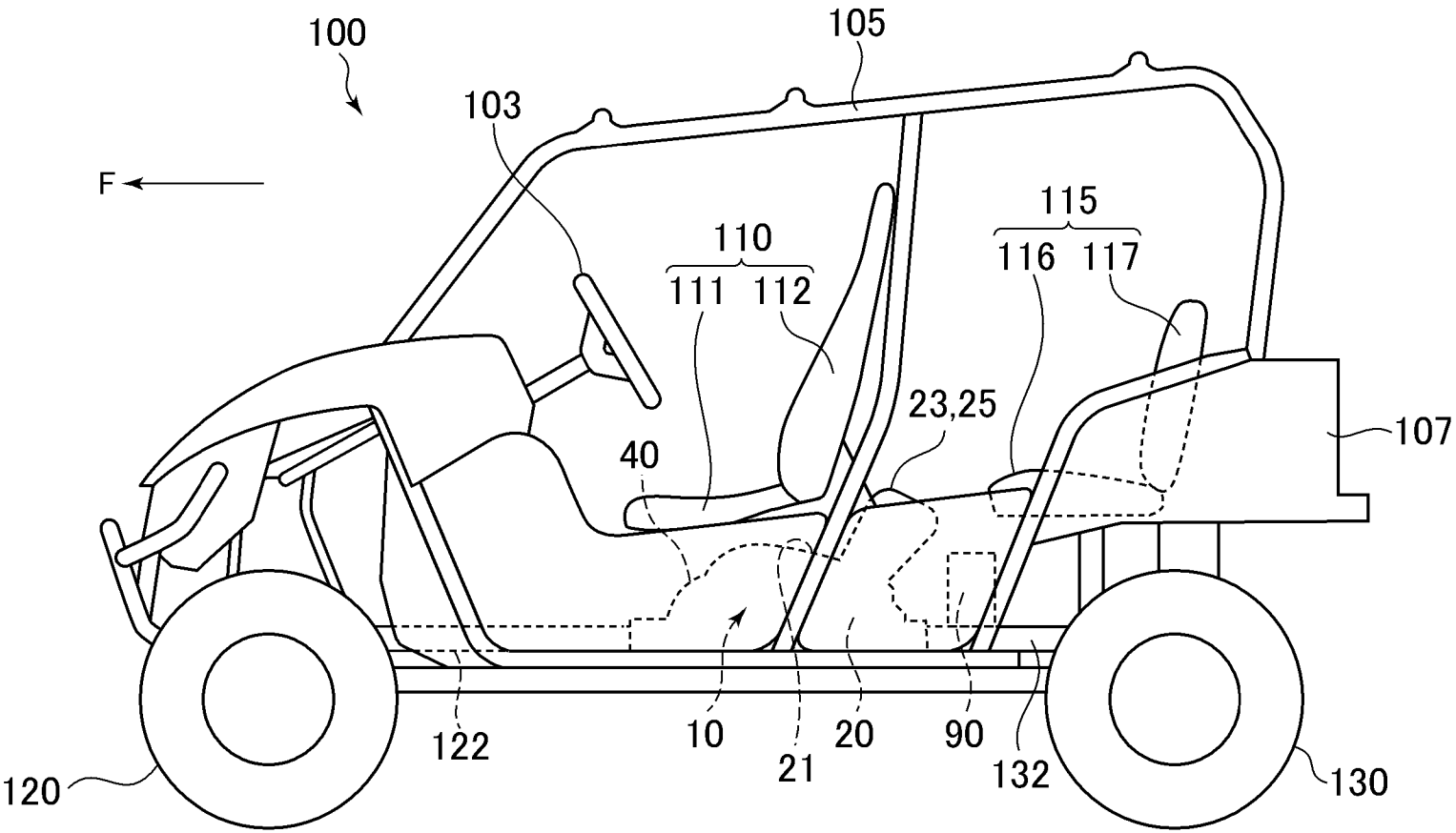
FIG. 1 is a left side view for illustrating a vehicle according to an embodiment of the vehicle.
Figure 2:
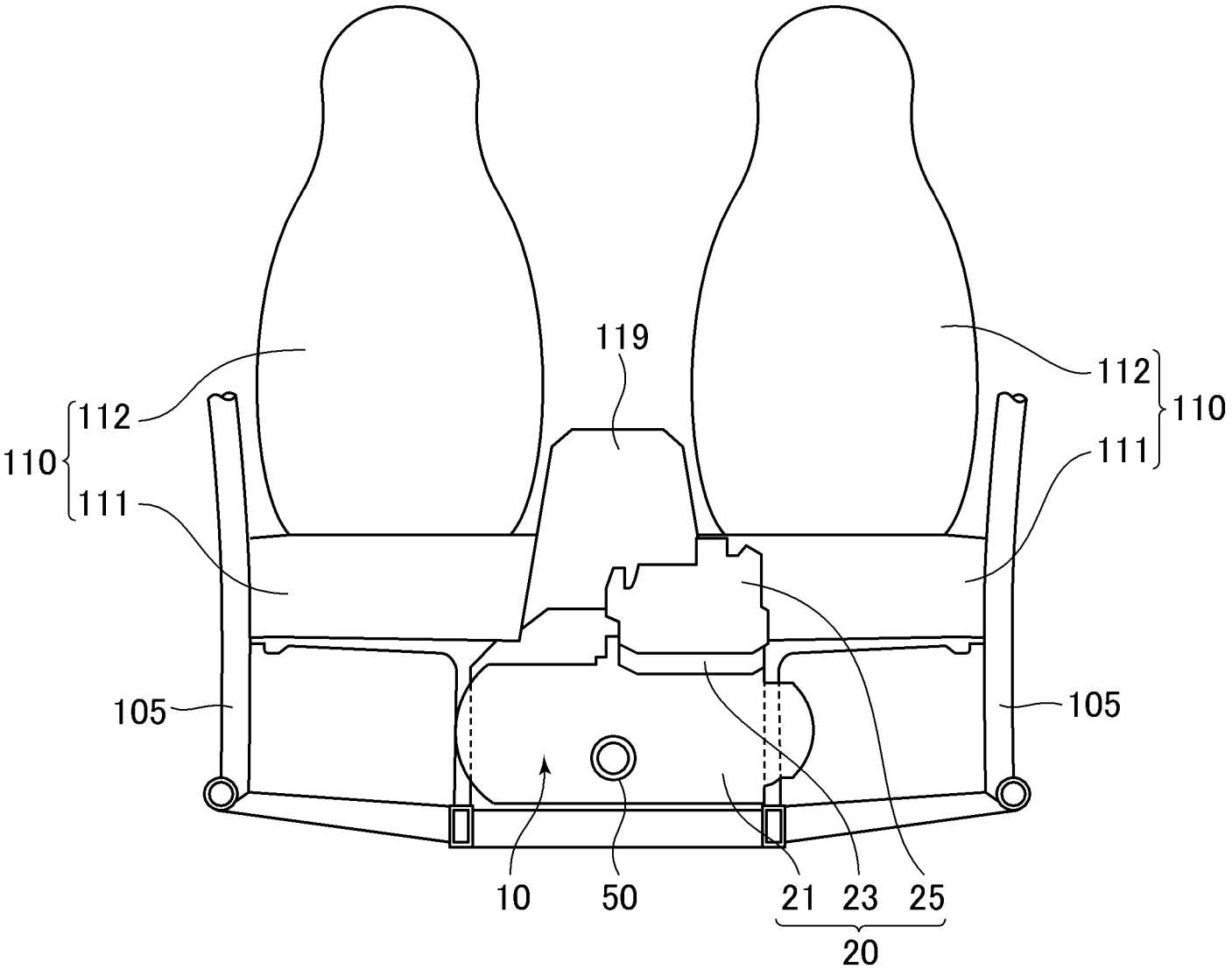
FIG. 2 is a back view for illustrating front row seats and a periphery thereof.

FIG. 1 is a left side view illustrating a vehicle 100 according to an embodiment. FIG. 2 is a back view ¥ illustrating front row seats 110 and a periphery thereof. In this embodiment, the vehicle 100 is a four-wheel-drive vehicle for use in rough terrain, which is called, for example, a recreational off-highway vehicle (ROV). Alternatively, the vehicle 100 may be a straddle-type four-wheel-drive vehicle including a steering bar, which is called, for example, an all terrain vehicle (ATV).

The arrow F in FIG. 1 indicates a forward direction of the vehicle 100. In the following description, a front side, a rear side, an upper side, a lower side, a left side, and a right side respectively refer to a front side, a rear side, an upper side, a lower side, a left side, and a right side of the vehicle seen toward a steering wheel 103 from a driver seated on one of the front row seats 110.

An engine unit 10 is arranged in a vicinity of a center of the vehicle 100 in a fore-and-aft direction and a right-and-left direction of the vehicle 100. A front propeller shaft 122 extends forward from the engine unit 10, and rotational power output from the engine unit 10 is transmitted to front wheels 120 through the front propeller shaft 122. A rear propeller shaft 132 extends rearward from the engine unit 10, and the rotational power output from the engine unit 10 is transmitted to rear wheels 130 through the rear propeller shaft 132. The front propeller shaft 122 and the rear propeller shaft 132 are coupled to a propeller shaft 50 (described later in detail) that passes through the engine unit 10 in the fore-and-aft direction.

The engine unit 10 includes an engine 20 arranged in a rear portion thereof, and a gear transmission 40 arranged in a front portion thereof. The engine 20 is, for example, a water-cooled four-cycle parallel two-cylinder engine. In the engine 20, a cylinder block 23 and a cylinder head 25 are arranged in inclined postures so as to be directed obliquely rearward and upward. The engine 20 is, for example, a dry sump engine, and a separate oil tank 90 is arranged behind the engine 20 to be coupled to the engine 20 through a pipe (not shown).

The plurality of front row seats 110 are arranged above or in a vicinity of the area above the engine unit 10 to be aligned in the right-and-left direction. The steering wheel 103 is arranged forward of the front row seats 110. A plurality of rear row seats 115 are arranged rearward of the front row seats 110 to be aligned in the right-and-left direction. A cabin frame 105 is arranged to surround a space for occupants in which the front row seats 110, the rear row seats 115, and the steering wheel 103 are contained. A cargo bed 107 is arranged rearward of the rear row seats 115 and above the rear wheels 130. The rear row seats 115 and the cargo bed 107 may be omitted.

The engine unit 10 is arranged so that at least a part of the engine unit 10 is located between the front row seats 110 and the rear row seats 115. Each of the front row seats 110 includes a seat portion 111 and a backrest portion 112, and each of the rear row seats 115 includes a seat portion 116 and a backrest portion 117. Specifically, at least a part of the engine 20, for example, the cylinder block 23 and the cylinder head 25 are located between the backrest portions 112 of the front row seats 110 and the seat portions 116 of the rear row seats 115.

Further, the engine unit 10 is arranged so that at least a part of the engine unit 10 is located below the front row seats 110. Specifically, the gear transmission 40 is located below the seat portions 111 of the front row seats 110. A part of the engine unit 10 excluding the cylinder block 23 and the cylinder head 25 is located below the seat portions 111 of the front row seats 110. Further, the engine unit 10 is arranged so that the propeller shaft 50 (described later in detail) passing through the engine unit 10 itself in the fore-and-aft direction is located near the center of the engine unit 10 in the right-and-left direction. The engine unit 10 may be arranged below the rear row seats 115.

Figure 3:
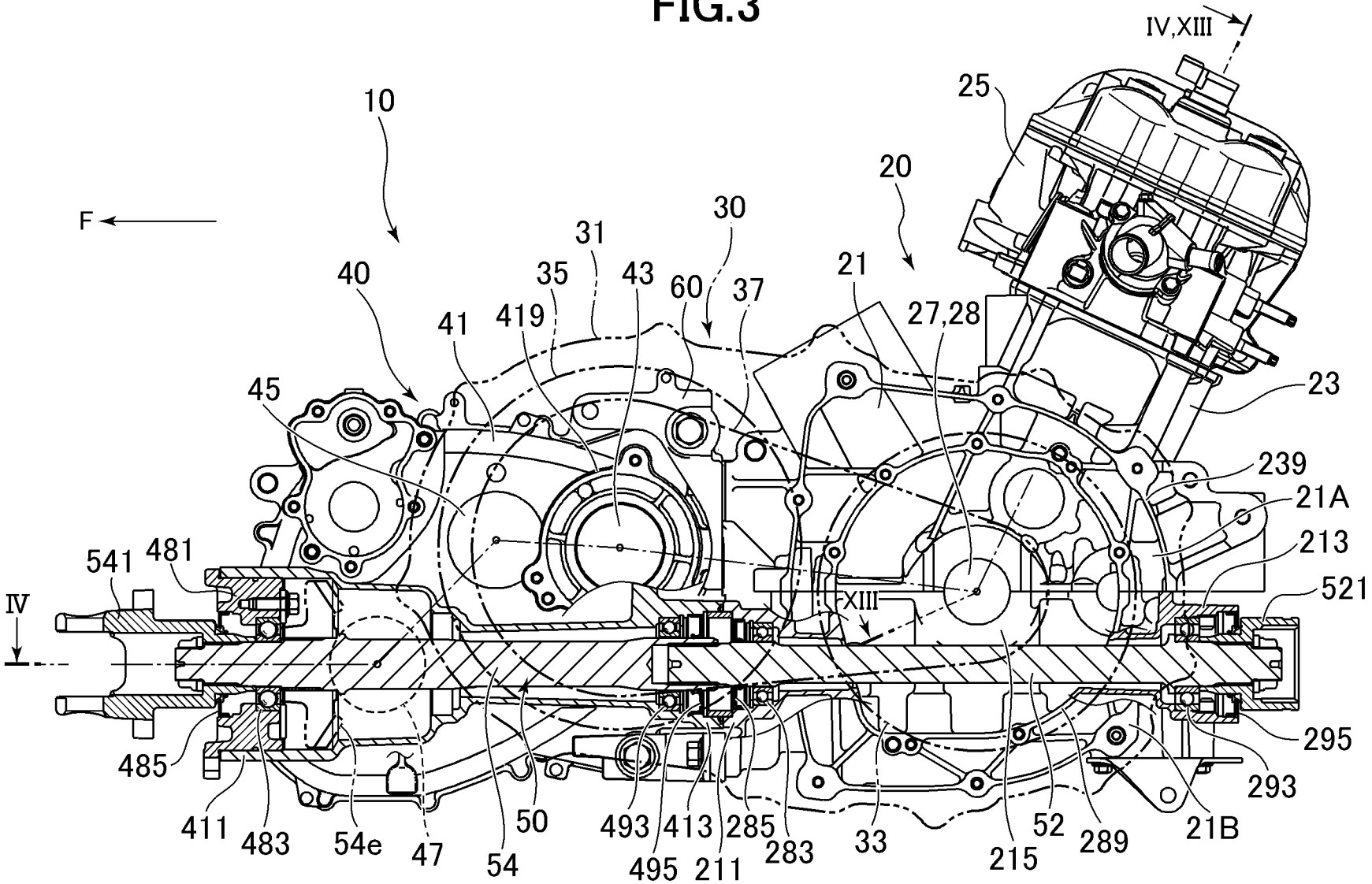
FIG. 3 is a left side view for illustrating an embodiment of an engine unit.

FIG. 3 is a left side view of the engine unit 10. In FIG. 3, the propeller shaft 50 and a periphery thereof are illustrated cut in an up-and-down direction of the vehicle along a plane passing an axis of the propeller shaft 50 (that is, cut along line III-III of FIG. 4).

Figure 4:
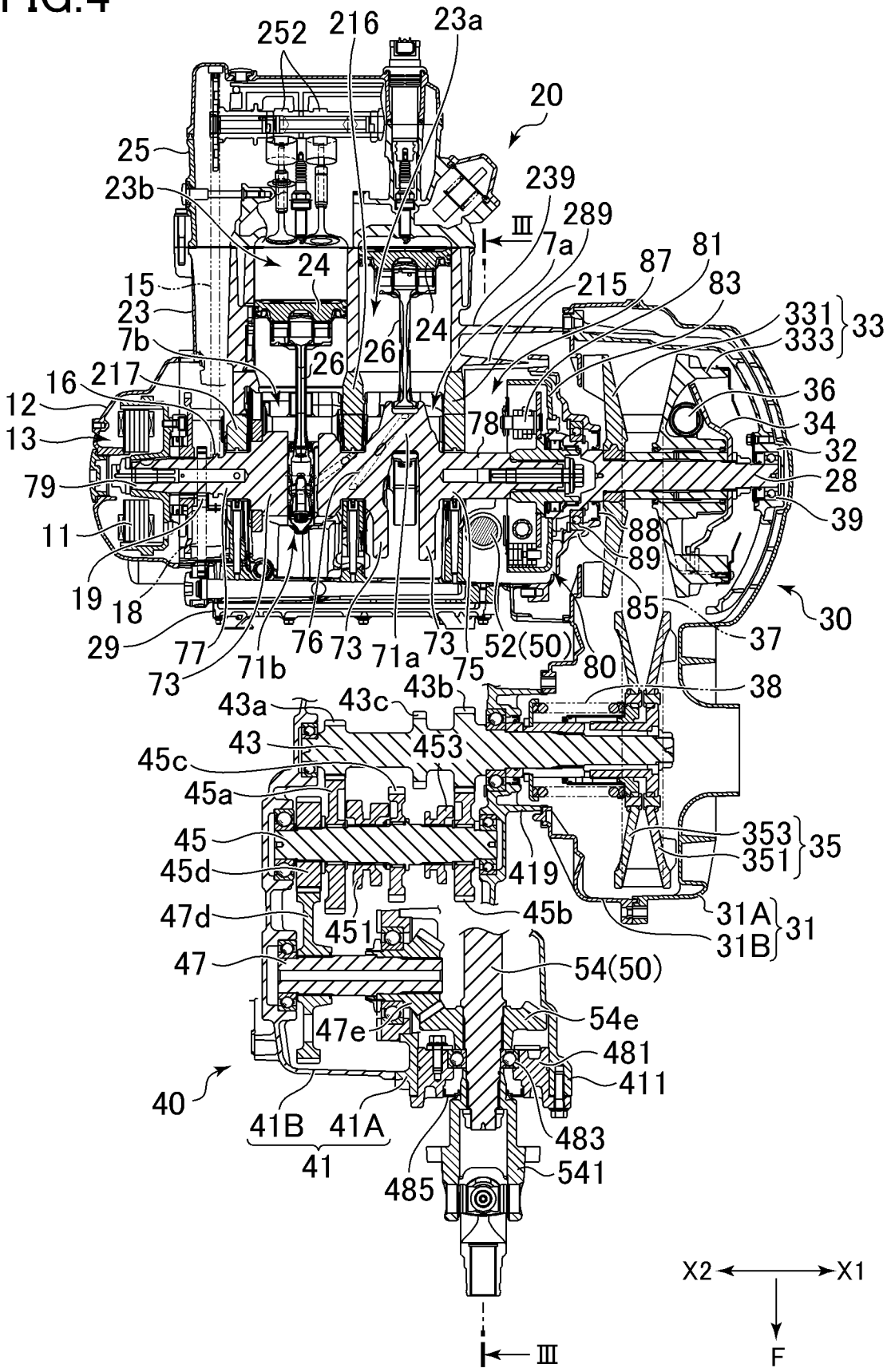
FIG. 4 is a developed sectional view for illustrating the engine unit.

FIG. 4 is a developed sectional view of the engine unit 10 taken along line IV-IV of FIG. 3. The line IV-IV is a polygonal line drawn by connecting a crankshaft 27, a secondary shaft 43, a transmission shaft 45, and an output shaft 47 in the stated order. The arrow X1 in FIG. 4 indicates a leftward direction, and the arrow X2 in FIG. 4 indicates a rightward direction (with respect to the forward direction F).

The engine unit 10 includes the crankshaft 27, the secondary shaft 43, the transmission shaft 45, and the output shaft 47 that extend in the right-and-left direction in parallel to one another. The crankshaft 27 is accommodated in a crankcase 21 of the engine 20. The secondary shaft 43, the transmission shaft 45, and the output shaft 47 are accommodated in a transmission case configured to accommodate the transmission 40 therein. The crankcase 21 and the transmission case 41 are coupled to each other through intermediation of an adapter 60.

Further, the engine unit 10 includes the propeller shaft 50 extending in the fore-and-aft direction. The propeller shaft 50 is arranged below the crankshaft 27, the secondary shaft 43, and the transmission shaft 45 to be orthogonal to the crankshaft 27, the secondary shaft 43, and the transmission shaft 45 in plan view. The propeller shaft 50 includes a rear shaft 52 passing through the crankcase 21 in the fore-and-aft direction, and a front shaft 54 passing through the transmission case 41 in the fore-and-aft direction. The rear shaft 52 and the front shaft 54 are coupled to each other.

The crankcase 21 includes an upper crankcase 21A and a lower crankcase 21B that are dividable in the up-and-down direction (direction perpendicular to an axis of the crankshaft 27) along a horizontal plane passing through the axis of the crankshaft 27. The cylinder block 23 is joined to an upper portion of the crankcase 21, and the cylinder head 25 is coupled to an upper portion of the cylinder block 23. An oil pan 29 is coupled to a lower portion of the crankcase 21.

Two cylinder bores 23*a* and 23*b* are formed in the cylinder block 23 to be aligned in the right-and-left direction. Pistons 24 and 24 are inserted into the cylinder bores 23*a* and 23*b*, respectively. The pistons 24 and 24 are coupled to the crankshaft 27 through connecting rods 26 and 26.

The crankshaft 27 includes left and right crankpins 71*a* and 71*b* to which the connecting rods 26 and 26 are coupled, respectively, crank webs 73, which are coupled together to sandwich each of the left and right crankpins 71*a* and 71*b* therebetween, and crank journals 75, 76, and 77, which are coupled to the crank webs 73.

An inside of the crankcase 21 is partitioned into two crank chambers 7*a* and 7*b* aligned in the right-and-left direction. The crankcase 21 includes three support wall portions 215, 216, and 217 aligned in the right-and-left direction. The left crank chamber 7*a* is defined between the left support wall portion 215 and the middle support wall portion 216, and the right crank chamber 7*b* is defined between the middle support wall portion 216 and the right support wall portion 217.

The left crankpin 71*a*, and the pair of crank webs 73 sandwiching the left crankpin 71*a* are accommodated in the left crank chamber 7*a*, and the right crankpin 71*b*, and the pair of crank webs 73 sandwiching the right crankpin 71*b* are accommodated in the right crank chamber 7*b*. The left crank journal 75 is supported by the left support wall portion 215, and the middle crank journal 76 is supported by the middle support wall portion 216. The right crank journal 77 is supported by the right support wall portion 217.

The crankshaft 27 further includes a right extending portion 79 extending rightward from the right support wall portion 217 of the crankcase 21. A generator 11 is mounted to the right extending portion 79. A generator cover 12 is mounted to a right side surface of the crankcase 21, and a generator chamber 13, configured to accommodate the generator 11 therein, is partitioned off in the crankcase 21.

A gear 16 and a gear 19 are mounted on a portion of the right extending portion 79 of the crankshaft 27 between the support wall portion 217 and the generator 11. The gear 16 is configured to drive, through a cam chain 15, a cam 252 mounted to the cylinder head 25. The gear 19 is configured to drive a pump unit (not shown) through a pump chain 18.

The crankshaft 27 further includes a left extending portion 78 extending leftward from the left support wall portion 215 of the crankcase 21. A centrifugal clutch 80 is arranged at a distal end portion of the left extending portion 78. The centrifugal clutch 80 is arranged coaxially with the crankshaft 27. A gap configured to position or accommodate the rear shaft 52 of the propeller shaft 50 therein, is formed between the left support wall portion 215 of the crankcase 21 and the centrifugal clutch 80.

A primary shaft 28 is arranged on the left side of the left extending portion 78, and the left extending portion 78 and the primary shaft 28 are coupled to each other through the centrifugal clutch 80. The centrifugal clutch 80 includes a clutch inner 81 (e.g., inner clutch portion) and a clutch outer 83 (e.g., outer clutch portion). The clutch inner 81 is mounted to the left extending portion 78, and the clutch outer 83 is mounted to the primary shaft 28. The centrifugal clutch 80 transmits the rotational power of the crankshaft 27 to the primary shaft 28 in such a manner that an outer peripheral surface of the clutch inner 81 is pressed to an inner peripheral surface of the clutch outer 83 by a centrifugal force accompanied with rotation of the crankshaft 27.

A clutch cover 85 is mounted to a left side surface of the crankcase 21, and a clutch chamber 87, configured to accommodate the centrifugal clutch 80 therein, is partitioned off in the crankcase 21. An annular edge portion 289 is formed on the left side surface of the crankcase 21 to extend leftward and surround the left extending portion 78. The clutch cover 85 is joined to (or extends to) the edge portion 289 to form the clutch chamber 87. The primary shaft 28 extends leftward from the clutch cover 85. A gap between the primary shaft 28 and the clutch cover 85 is sealed by a sealing member 88. A proximal end portion of the primary shaft 28, which is coupled to the clutch outer 83, is supported by the clutch cover 85 through intermediation of a bearing 89.

A belt type continuously variable transmission (CVT) 30 configured to transmit the rotational power from the engine 20 to the transmission 40 is arranged on the left side of the engine 20 and the transmission 40. The rotational power of the primary shaft 28 coupled to the crankshaft 27 of the engine 20 through the centrifugal clutch 80 is continuously varied by the belt type CVT 30, and then is transmitted to the secondary shaft 43 arranged in the transmission 40. The belt type CVT 30 includes a drive pulley 33 mounted to the primary shaft 28, a driven pulley 35 mounted to a left end portion of the secondary shaft 43, and a rubber belt 37 wound around the drive pulley 33 and the driven pulley 35. The belt 37 may be made of metal or a resin.

The belt type CVT 30 is accommodated in a CVT case 31 provided separately from the crankcase 21 and the transmission case 41. The CVT case 31 includes a left CVT case 31A and a right CVT case 31B that are dividable in the right-and-left direction. An annular edge portion 239 is formed on the left side surface of the crankcase 21 to extend leftward and surround the edge portion 283 forming the clutch chamber 87. A rear portion of the CVT case 31 is joined to the edge portion 239. An edge portion 419 is also formed on a left side surface of the transmission case 41 to extend leftward and surround the secondary shaft 43. A front portion of the CVT case 31 is joined to the edge portion 419.

The drive pulley 33 includes a stationary sheave 331 fixed to the primary shaft 28, and a movable sheave 333 mounted to the primary shaft 28 and movable in an axial direction. A weight 36 is arranged between the movable sheave 333 and a cam plate 34 fixed to the primary shaft 28. The weight 36 is configured to move the movable sheave 333 in the axial direction by the centrifugal force accompanied with rotation of the primary shaft 28. The distal end portion of the primary shaft 28 is supported through intermediation of a bearing 39 by a housing 32 formed inside the CVT case 31.

The driven pulley 35 includes a stationary sheave 351 fixed to the secondary shaft 43, and a movable sheave 353 mounted to the secondary shaft 43 and movable in the axial direction. A coil spring 38 applies pressure to the movable sheave 353 in a direction toward the stationary sheave 351.

The transmission 40 changes the rotational power of the secondary shaft 43 to any one of a high mode, a low mode, and a reverse mode, and then transmits the rotational power to the transmission shaft 45. The transmission 40 further transmits the rotational power, which has transmitted to the transmission shaft 45, from the output shaft 47 to the propeller shaft 50. The transmission 40 is accommodated in the transmission case 41 provided separately from the crankcase 21 and the CVT case 31. The transmission case 41 includes a left transmission case 41A and a right transmission case 41B that are dividable in the right-and-left direction (direction of the axis).

A low drive gear 43*a*, a high drive gear 43*b*, and a reverse drive gear 43*c* are formed integrally with the secondary shaft 43. A low driven gear 45*a*, a high driven gear 45*b*, and a reverse driven gear 45*c* are mounted to the transmission shaft 45 and are rotatable relative to one another. The low drive gear 43*a* and the low driven gear 45*a* mesh with each other, and the high drive gear 43*b* and the high driven gear 45*b* mesh with each other. Further, the reverse drive gear 43*c* and the reverse driven gear 45*c* respectively mesh with gears formed on a countershaft (not shown).

Dog clutches 451 and 453 are mounted to the transmission shaft 45 and are rotatable relative to one another in their axial direction. Further, a drive gear 45*d* is spline-connected to the transmission shaft 45. When the dog clutch 451 meshes with the low driven gear 45*a*, the transmission shaft 45 is rotated together with the low driven gear 45*a*. When the dog clutch 453 meshes with the high driven gear 45*b*, the transmission shaft 45 is rotated together with the high driven gear 45*b*. When the dog clutch 451 meshes with the reverse driven gear 45*c*, the transmission shaft 45 is rotated together with the reverse driven gear 45*c*.

A driven gear 47*d*, which meshes with the drive gear 45*d* of the transmission shaft 45, is spline-connected to the output shaft 47, and the rotational power of the transmission shaft 45 is transmitted to the output shaft 47. Further, a bevel gear 47*e* is spline-connected to the output shaft 47. A bevel gear 54*e*, which meshes with the bevel gear 47*e* of the output shaft 47, is spline-connected to the front shaft 54 of the propeller shaft 50 arranged in the transmission case 41, and the rotational power of the output shaft 47 is transmitted to the front shaft 54.

The front shaft 54 is arranged in the transmission case 41 to pass through the transmission case 41 in the fore-and-aft direction, and the rear shaft 52 is arranged in the crankcase 21 to pass through the crankcase 21 in the fore-and-aft direction. The front shaft 54 and the rear shaft 52 are coupled to each other, and thus construct the propeller shaft 50. Specifically, a front end portion of the rear shaft 52 protruding forward from the crankcase 21 is inserted into and spline-connected to a rear end portion of the front shaft 54 protruding rearward from the transmission case 41.

The rear end portion of the front shaft 54 is supported through intermediation of a bearing 493 by an annular shaft support portion 413 formed on a rear wall of the transmission case 41. A gap between the rear end portion of the front shaft 54 and the shaft support portion 413 is sealed by a sealing member 495. The front end portion of the rear shaft 52 is supported through intermediation of a bearing 283 by an annular shaft support portion 211 formed on a front wall of the crankcase 21. A gap between the front end portion of the rear shaft 52 and the shaft support portion 211 is sealed by a searing member 285.

An annular shaft support portion 411, which protrudes forward, is formed on a front wall of the transmission case 41. Annular cap 481 is fitted inside the shaft support portion 411. A front end portion of the front shaft 54 is supported through intermediation of a bearing 483 by the cap 481 fitted inside the shaft support portion 411. A gap between the front end portion of the front shaft 54 and the cap 481 is sealed by a sealing member 485. A coupling member 541 is mounted to the front end portion of the front shaft 54. The front propeller shaft 122 (see FIG. 1) is coupled to the coupling member 541.

An annular shaft support portion 213, which protrudes rearward, is formed on a rear wall of the crankcase 21. A rear end portion of the rear shaft 52 is supported by the shaft support portion 213 through intermediation of a bearing 293. A gap between the rear end portion of the rear shaft 52 and the shaft support portion 213 is sealed by a sealing member 295. A coupling member 521 is mounted to the rear end portion of the rear shaft 52. The rear propeller shaft 132 (see FIG. 1) is coupled to the coupling member 521.

Figure 6:
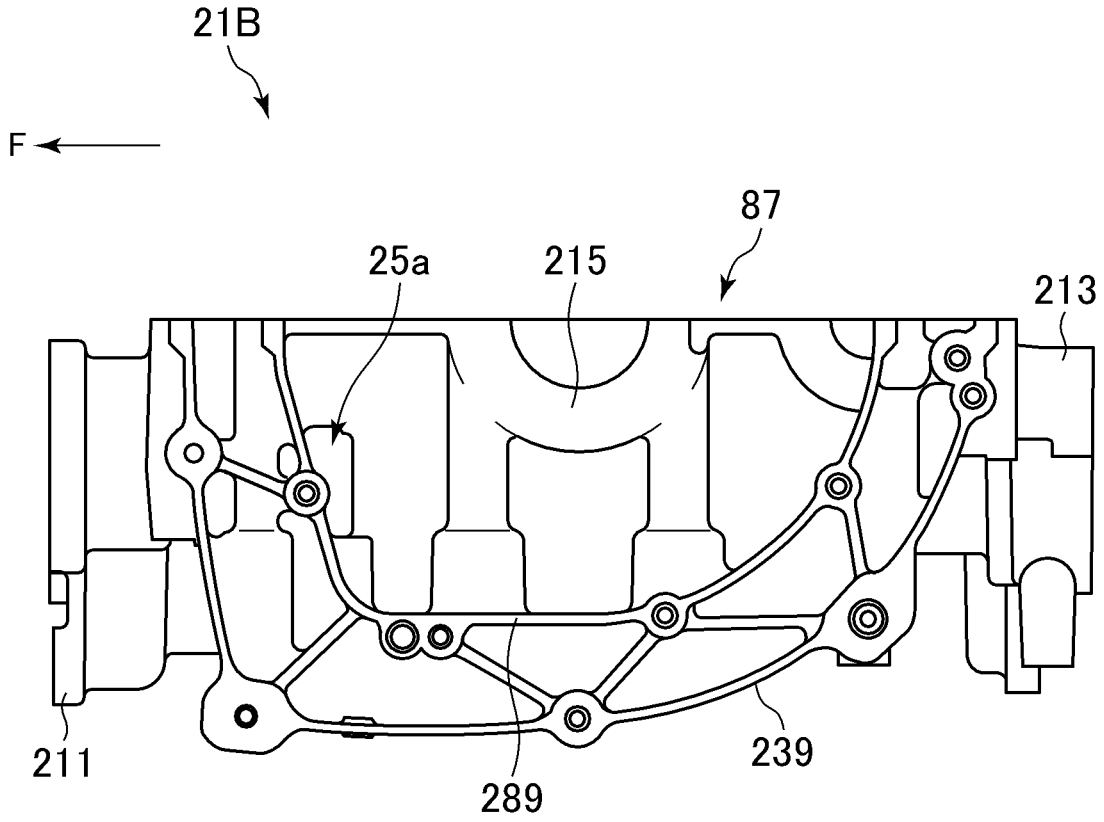
FIG. 6 is a left side view for illustrating the lower crankcase.
Figure 7:
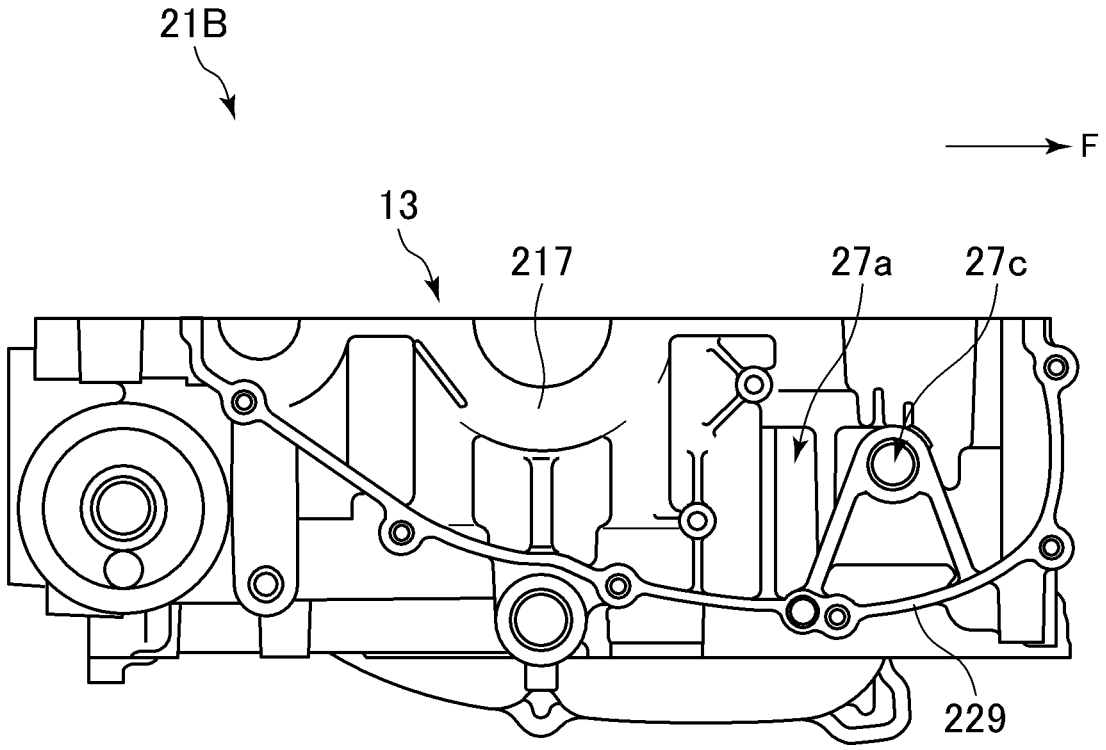
FIG. 7 is a right side view for illustrating the loner crankcase.
Figure 8:
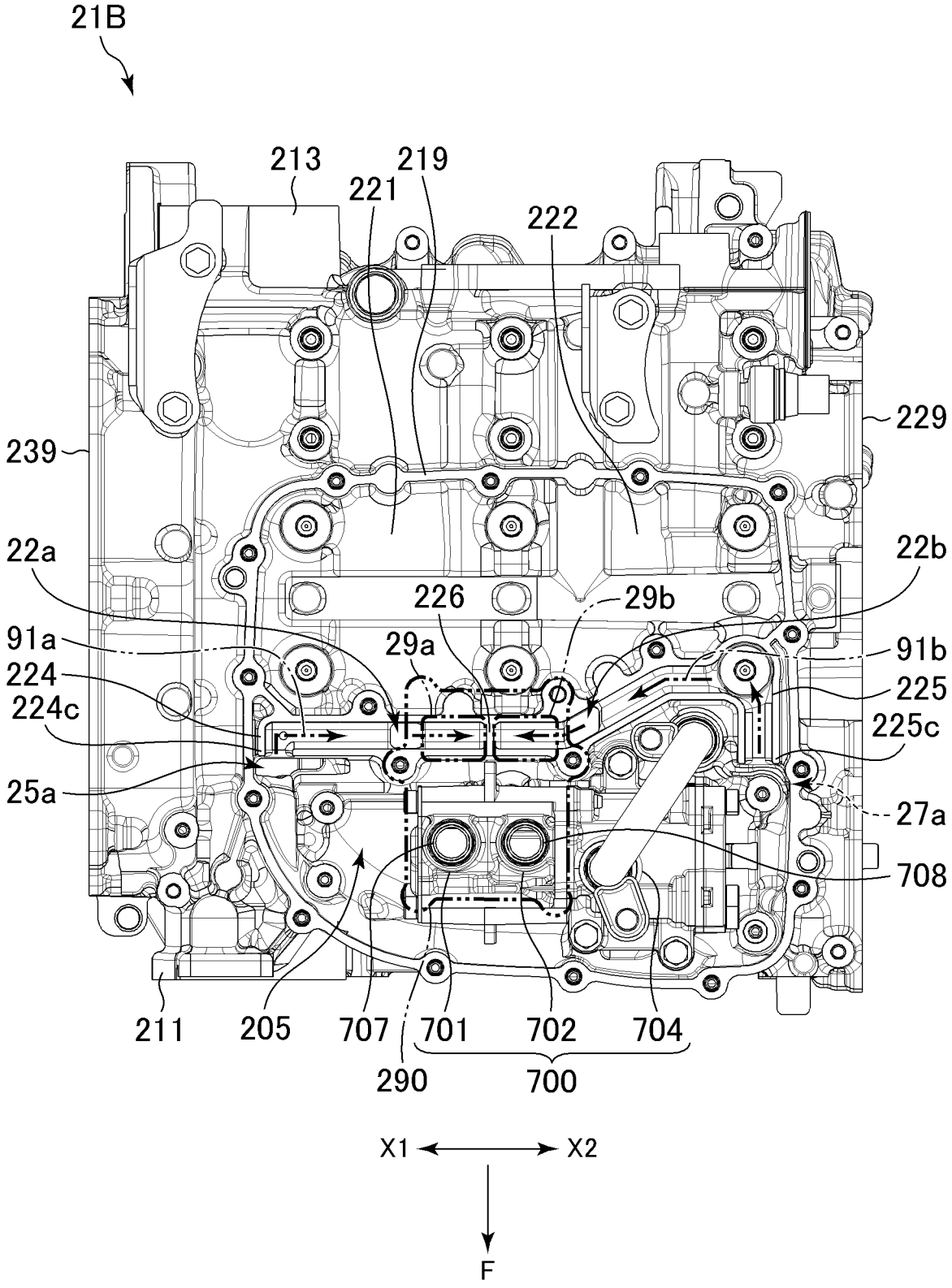
FIG. 8 is a bottom view for illustrating the lower crankcase.
Figure 9:
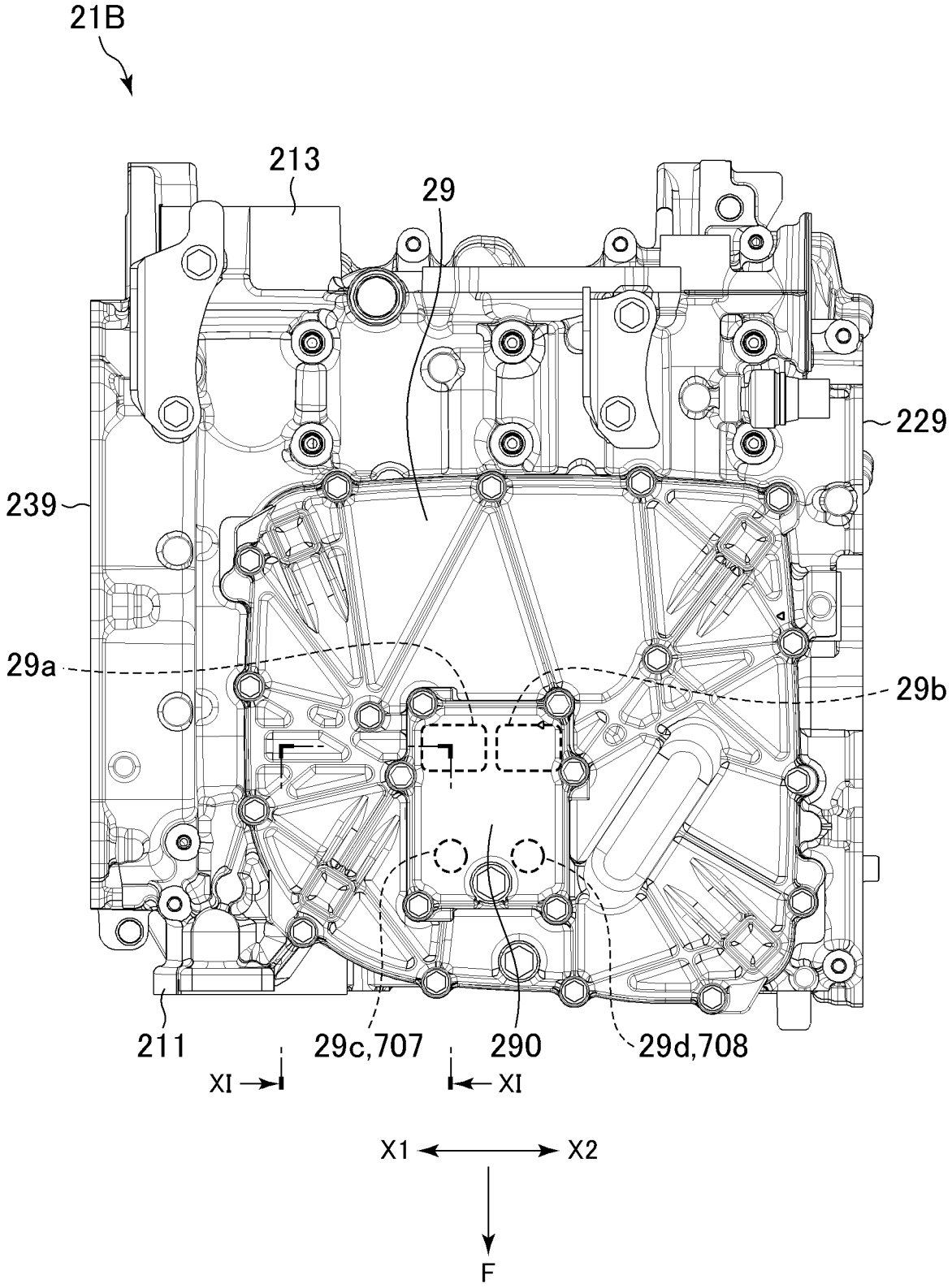
FIG. 9 is a bottom view for illustrating the lower crankcase to which an oil pan is mounted.

FIG. 5 to FIG. 8 illustrate a top view, a left side view, a right side view, and a bottom view of a lower crankcase 21B, respectively. FIG. 8 is an illustration of a state in which a pump unit 700 is arranged in the lower crankcase 21B. FIG. 9 is a bottom view for illustrating the lower crankcase 21B to which an oil pan 29 and a cover 290 are mounted.

Figure 10:
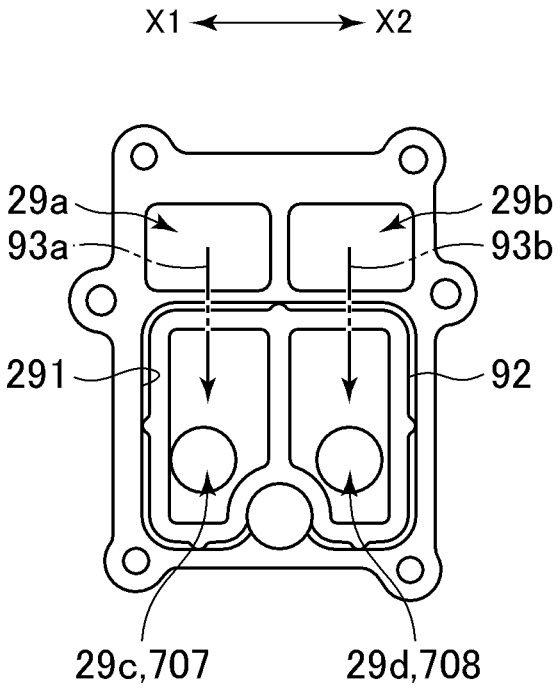
FIG. 10 is an enlarged bottom view for illustrating a region of the oil pan, which is covered with a cover.
Figure 11:
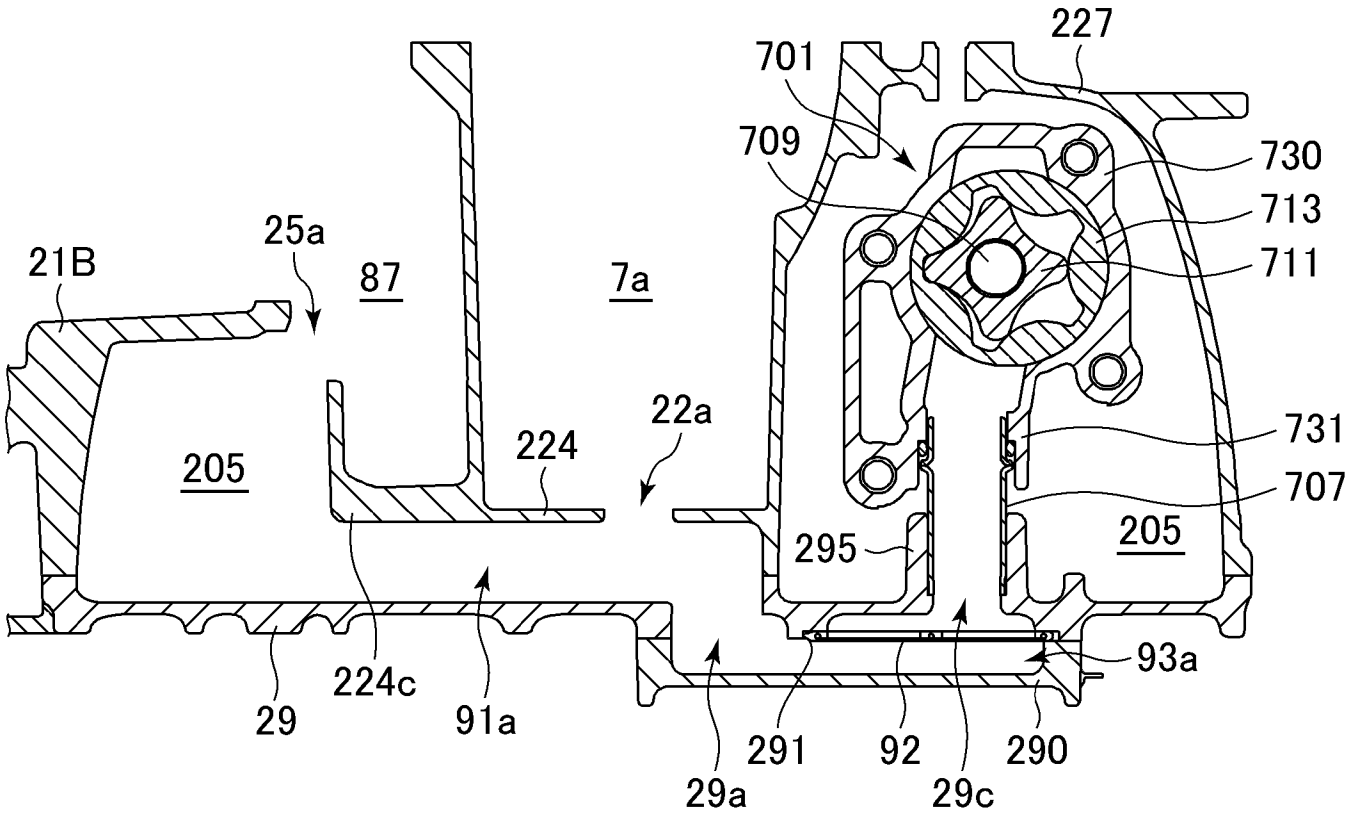
FIG. 11 is a sectional view for illustrating the lower crankcase to which the oil pan is mounted.

FIG. 10 is an enlarged bottom view for illustrating a region of the oil pan 29, which is covered with the cover 290. In FIG. 10, only the covered region of the oil pan 29 is illustrated, and the illustration of a region other than the covered region is omitted. FIG. 11 is a sectional view for illustrating the lower crankcase 21B, to which the oil pan 29 and the cover 290 are mounted, when the lower crankcase 21B is cut along line XI-XI of FIG. 9.

Figure 5:
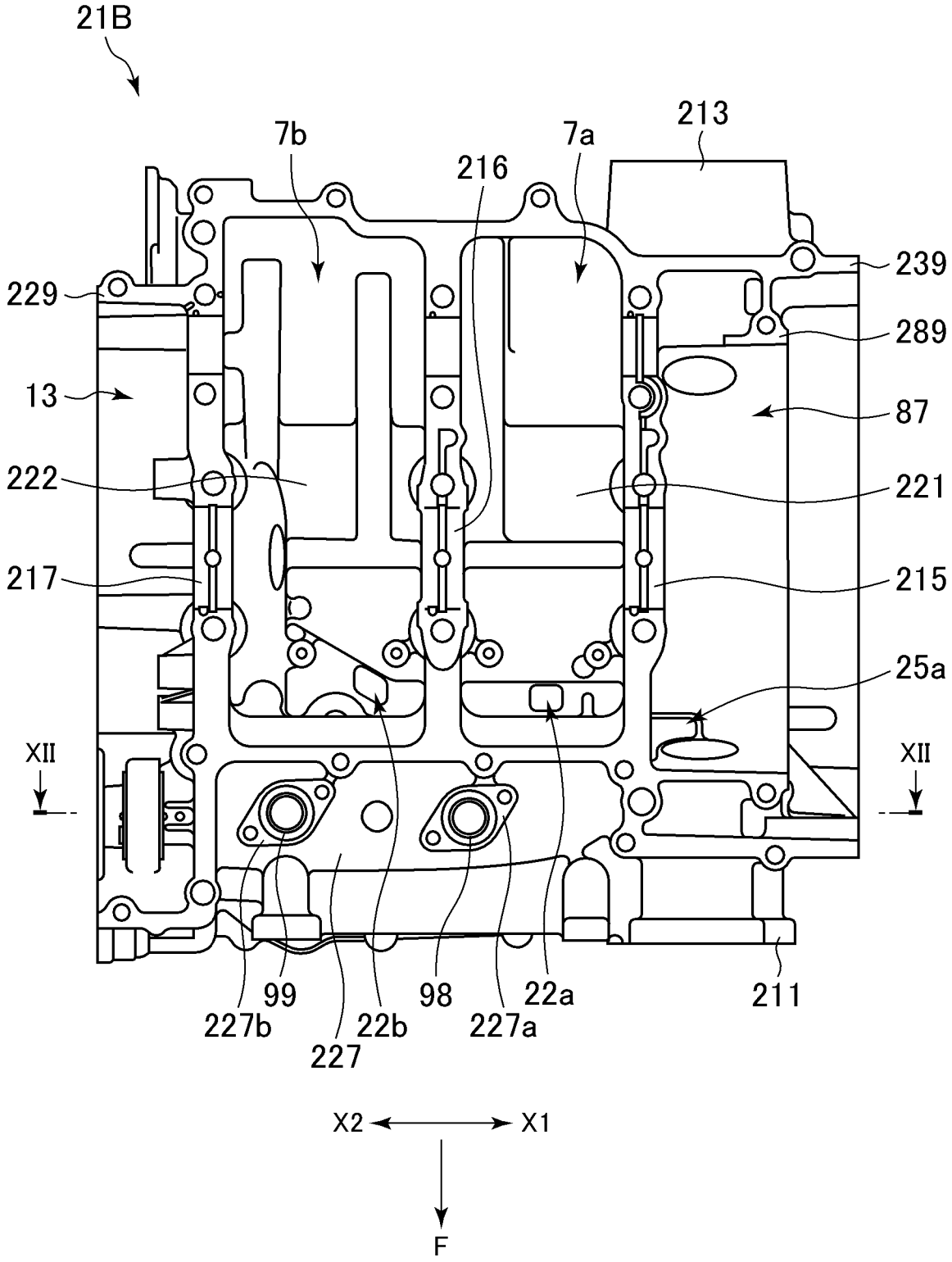
FIG. 5 is a top view for illustrating an embodiment of a lower crankcase.
Figure 12:
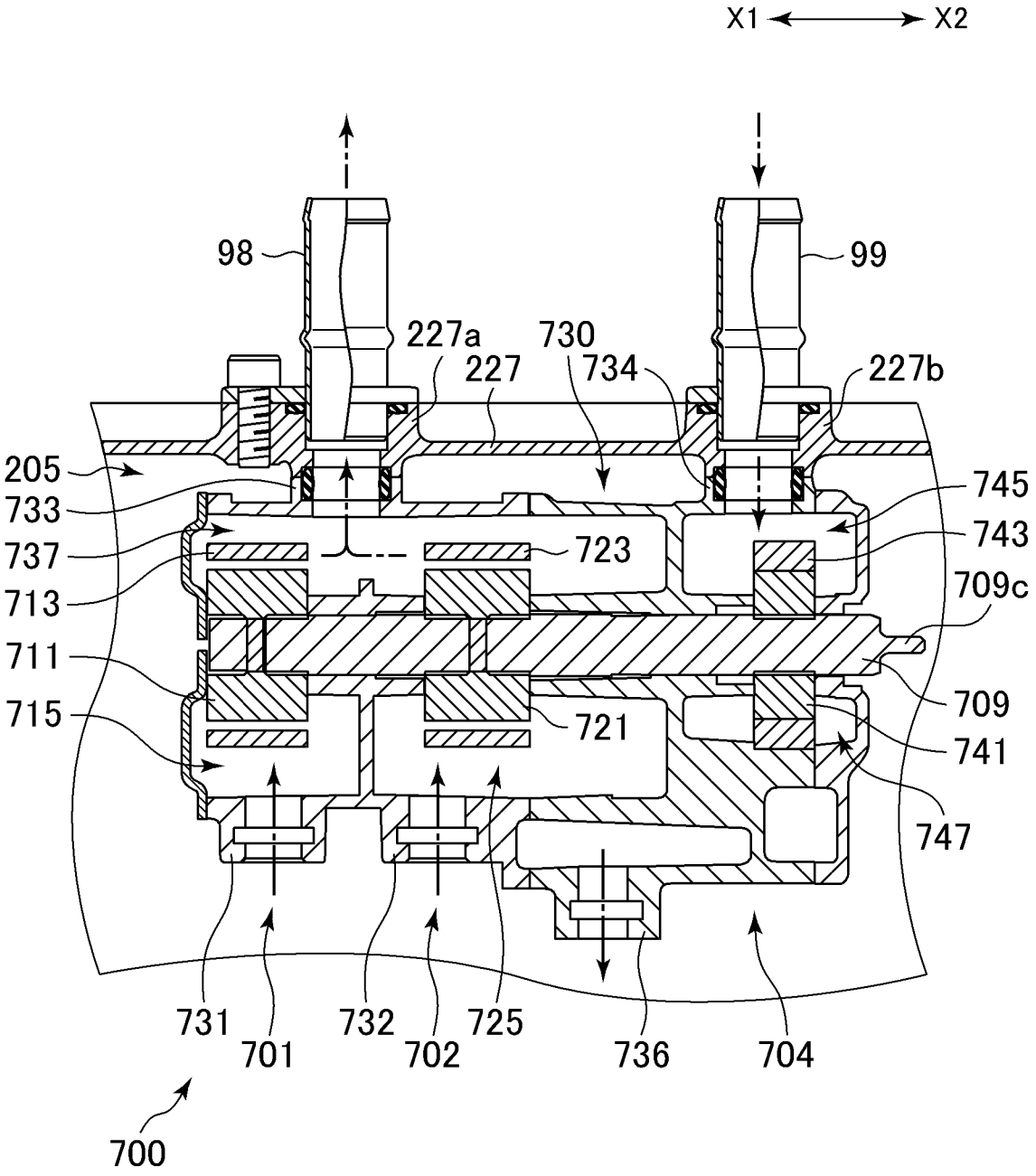
FIG. 12 is a sectional view for illustrating an embodiment of a pump unit.
Figure 13:
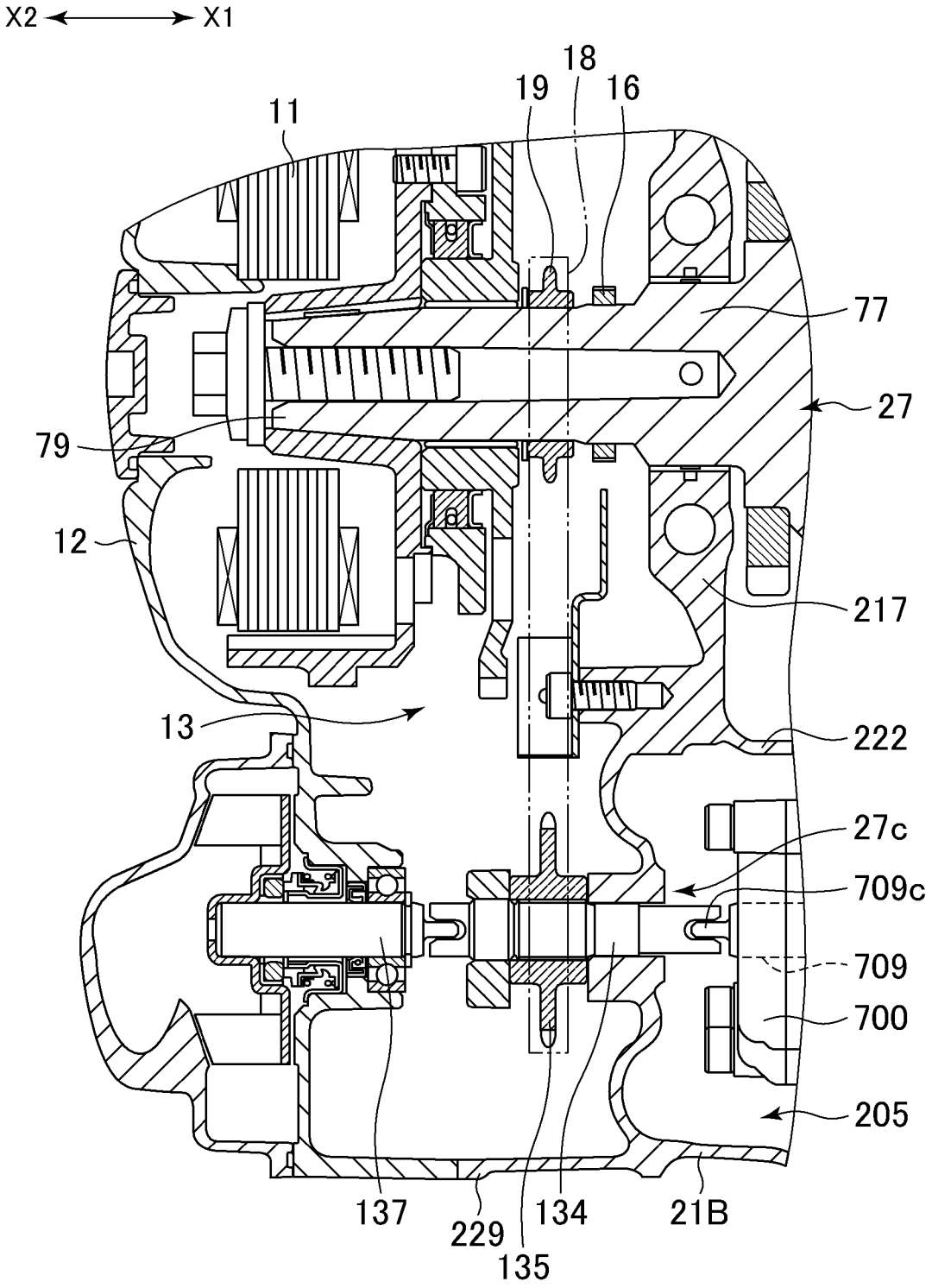
FIG. 13 is an enlarged sectional view for illustrating an embodiment of a main part of an engine.

FIG. 12 is a sectional view for illustrating the pump unit 700 when the pump unit 700 is cut along line XII-XII of FIG. 5. FIG. 13 is an enlarged sectional view for illustrating a generator chamber 13 and a periphery thereof when an engine 20 is taken along line XIII-XIII of FIG. 3.

As illustrated in FIG. 5, the lower crankcase 21B includes three support wall portions 215, 216, and 217 aligned in a right-and-left direction of a vehicle. A left crank chamber 7*a* is formed between the left support wall portion 215 and the middle support wall portion 216, and a right crank chamber 7*b* is formed between the middle support wall portion 216 and the right support wall portion 217.

A lower wall 221 is formed at a lower portion of the left crank chamber 7*a* formed between the left support wall portion 215 and the middle support wall portion 216. The lower wall 221 is inclined forward and downward, and a through-hole 22*a* is formed in a front end portion of the lower wall 221 to pass through the lower wall 221 in an up-and-down direction of the vehicle. As a result of the inclination of the lower wall 221, oil in the left crank chamber 7*a* is collected toward the through-hole 22*a* to flow downward through the through-hole 22*a*.

A lower wall 222 is formed at a lower portion of the right crank chamber 7*b* formed between the middle support wall portion 216 and the right support wall portion 217. The lower wall 222 is inclined forward and downward, and a through-hole 22*b* is formed in a front end portion of the lower wall 222 to pass through the lower wall 222 in the up-and-down direction. As a result of the inclination of the lower wall 222, oil in the right crank chamber 7*b* is collected toward the through-bole 22*b* to flow downward through the through-hole 22*b*.

An upper wall 227 is formed forward of the crank chambers 7*a* and 7*b*. The upper wall 227 covers a relay chamber 205 (see, for example, FIG. 11) for accommodating therein the pump unit 700 described later. Two mounting portions 227*a* and 227*b* are formed on the upper wall 227 to be apart from each other in the right-and-left direction. Pipes 98 and 99, which are connected to an oil tank 90 (see FIG. 1), are mounted to the mounting portions 227*a* and 227*b*, respectively.

As illustrated in FIG. 5 and FIG. 6, an edge portion 289 is formed on a left side surface of the lower crankcase 21B, and extends leftward from the left support wall portion 215 to define a clutch chamber 87. A through-hole 25*a* is formed in a front portion of the left support wall portion 215 and inside the edge portion 289 to pass through the left support wall portion 215 in the right-and-left direction and the up-and-down direction. The oil in the clutch chamber 87 flows through the through-hole 25*a* into the relay chamber 205 formed on a right side of the left support wall portion 215 and below the upper wall 227.

As illustrated in FIG. 5 and FIG. 7, an edge portion 229 is formed on a right side surface of the lower crankcase 21B, and extends rightward from the right support wall portion 217 to define the generator chamber 13. A through-hole 27*a* is formed in a front portion of the right support wall portion 217 and inside the edge portion 229 to pass through the right support wall portion 217 in the right-and-left direction. The oil in the generator chamber 13 flows through the through-hole 27*a* into the relay chamber 205 formed on a left side of the right support wall portion 217 and below the upper wall 227.

Further, a shaft support hole 27*c* is formed in a front portion of the right support wall portion 217, inside the edge portion 229, and forward of the through-hole 27*a* to pass through the right support wall portion 217 in the right-and-left direction. A shaft portion 134 (see FIG. 13) configured to drive the pump unit 700 described later is inserted into the shaft support hole 27*c*.

As illustrated in FIG. 8, an annular lower edge 219, which is joined to a peripheral edge of the oil pan 29, is formed on a lower surface of the lower crankcase 21B. Passage forming portions 224 and 225 are formed on the lower surface of the lower crankcase 21B into semi-cylindrical shapes to be open downward. The passage forming portions 224 and 225 are joined to the oil pan 29, and thus form oil passages (first passages) 91*a* and 91*b*. The passage forming portions 224 and 225 are aligned in the right-and-left direction inside the annular lower edge 219 and cross a center portion in a fore-and-aft direction of the annular lower edge 219.

A partition portion 226 configured to partition the oil passages 91*a* and 91*b* is formed between the passage forming portions 224 and 225 aligned in the right-and-left direction. However, the partition portion 226 may be omitted.

The relay chamber 205 is formed forward of the passage forming portions 224 and 225, and the pump unit 700 is arranged in the relay chamber 205. In this embodiment, the pump unit 700 includes two scavenge pumps 701 and 702, and one feed pump 704. The scavenge pumps 701 and 702, and the feed pump 704 are aligned in the right-and-left direction so that the feed pump 704 is located at a rightmost position.

The through-hole 22*a* connected to the left crank chamber 7*a* is formed in a halfway portion of the left passage forming portion 224. The oil in the left crank chamber 7*a* flows through the through-hole 22*a* into the left oil passage 91*a* formed by the left passage forming portion 224, and then flows rightward in the left oil passage 91*a*.

An opening 224*c* is formed in a left end portion of the left passage forming portion 224 to be open toward the relay chamber 205. The through-hole 25*a* connected to the clutch chamber 87 is formed in a vicinity of the opening 224*c*. The oil in the clutch chamber 87 flows into the relay chamber 205 through the through-hole 25*a*, and also flows into the left oil passage 91*a* through the opening 224*c* formed in the vicinity of the through-hole 25*a* to flow rightward in the left oil passage 91*a*.

The through-hole 22*b* connected to the right crank chamber 7*b* is formed in a halfway portion of the right passage forming portion 225. The oil in the right crank chamber 7*b* flows through the through-hole 22*b* into the right oil passage 91*b* formed by the right passage forming portion 225, and then flows leftward in the right oil passage 91*b*.

An opening 225*c* is formed in a right end portion of the right passage forming portion 225 to generally bent forward and open toward the relay chamber 205. The through-hole 27*a* connected to the generator chamber 13 is formed in a vicinity of the opening 225*c*. The oil in the generator chamber 13 flows into the relay chamber 205 through the through-hole 27*a*, and also flows into the right oil passage 91*b* through the opening 225*c* formed in the vicinity of the through-hole 27*a* to flow leftward in the right oil passage 91*b*.

The oil flowing into the relay chamber 205 from the clutch chamber 87 through the through-hole 25*a*, and the oil flowing into the relay chamber 205 from the generator chamber 13 through the through-hole 27*a* are temporarily accumulated in the relay chamber 205, but finally flow into the oil passages 91*a* and 91*b* through the openings 224*c* and 225*c*. The oil that oozes out of the pump unit 700 similarly flows into the oil passages 91*a* and 91*b* through the openings 224*c* and 225*c*.

As illustrated in FIG. 9, the oil pan 29 is mounted to a lower surface of the lower crankcase 21B. The oil pan 29 is formed into a substantially plate-like shape, and the oil pan 29 itself does not have a structure capable of accumulating the oil (see FIG. 11). Further, the cover 290 is mounted to a part of a lower surface of the oil pan 29.

As illustrated in FIG. 8 to FIG. 11, a plurality of through-holes 29*a* to 29*d* are formed in the region of the oil pan 29, which is covered with the cover 290. The cover 290 is formed into a dish-like shape having a dent (e.g., protruding portion). The cover 290 is joined to the oil pan 29, and thus forms oil passages (second passages) 93*a* and 93*b*.

Specifically, when the oil pan 29 and the cover 290 are joined to each other, the left oil passage 93*a* is formed between the left rear through-hole 29*a* and the left front through-hole 29*c* among the four through-holes 29*a* to 29*d*, and the right oil passage 93*b* is formed between the right rear through-hole 29*b* and the right front through-hole 29*d* among the four through-holes 29*a* to 29*d*.

The left oil passage 93*a* is coupled to a downstream side of the left oil passage 91*a* formed by the left passage forming portion 224 of the lower crankcase 21B and the oil pan 29. The left rear through-hole 29*a* is connected to a right end portion of the left oil passage 91*a*. The left scavenge pump 701 is coupled to a downstream side of the left oil passage 93*a* through a pipe 707.

The oil pan 29 includes a tubular portion 295 (see FIG. 11) extending upward and having the left front through-hole 29*c* formed therein. An upper portion of the pipe 707 is inserted into a suction port 731 of the left scavenge pump 701, and a lower portion of the pipe 707 is inserted into the tubular portion 295. The left front through-hole 29*c* is located directly below the suction port 731 of the left scavenge pump 701, and the pipe 707 extends in the up-and-down direction. The right front through-hole 29*d* also has a similar configuration.

The oil flowing rightward in the left oil passage 91*a* flows into the left oil passage 93*a* through the through-hole 29*a* before reaching the partition portion 226, and further flows from the left oil passage 93*a* through the pipe 707 to be sucked into the left scavenge pump 701.

The right oil passage 93*b* is coupled to a downstream side of the right oil passage 91*b* formed by the right passage forming portion 225 of the lower crankcase 21B and the oil pan 29. The right rear through-hole 29*b* is connected to a left end portion of the right oil passage 91*b*. The right scavenge pump 702 is coupled to a down stream side of the right oil passage 93*b* through a pipe 72.

The oil flowing leftward in the right oil passage 91*b* flows into the right oil passage 93*b* through the through-hole 29*b* before reaching the partition portion 226, and further flows from the right oil passage 93*b* through the pipe 708 to be sucked into the right scavenge pump 702.

A recessed portion 291 is formed in a range of the oil pan 29, which contains both the left front through-hole 29*c* and the right front through-hole 29*d*. A strainer 92 is arranged inside the recessed portion 291, and covers the two through-holes 29*c* and 29*d*. The oil flowing in the oil passages 93*a* and 93*b* is sucked into the scavenge pumps 701 and 702 after filtered by the strainer 92.

As illustrated in FIG. 12, the pump unit 700 includes the two scavenge pumps 701 and 702 and the one feed pump 704 arranged in the stated order from a left side of the vehicle. The scavenge pumps 701 and 702 and the feed pump 704 are integrated with one another by a common housing 730, and are driven by a common pump driving shaft 709.

The left scavenge pump 701 includes an inner rotor 711 fixed to the pump driving shaft 709, and an outer rotor 713 retained in the housing 730. In accordance with relative rotation of the inner rotor 711 and the outer rotor 713, the left scavenge pump 701 sucks the oil from the suction port 731 into a suction chamber 715, feeds the oil in the suction chamber 715 into a discharge chamber 737, and discharges the oil in the discharge chamber 737 from a discharge port 733.

The right scavenge pump 702 includes an inner rotor 721 fixed to the pump driving shaft 709, and an outer rotor 723 retained in the housing 730. In accordance with relative rotation of the inner rotor 721 and the outer rotor 723, the right scavenge pump 702 sucks the oil from the suction port 732 into a suction chamber 725, feeds the oil in the suction chamber 725 into the discharge chamber 737, and discharges the oil in the discharge chamber 737 from the discharge port 733.

As described above, the pipe 707 coupled to the left oil passage 93*a* is inserted into the suction port 731 of the left scavenge pump 701 (see FIG. 8 to FIG. 11). Further, the pipe 708 coupled to the right oil passage 93*b* is inserted into the suction port 732 of the right scavenge pump 702.

The common discharge chamber 737 and the common discharge port 733 are formed for the scavenge pumps 701 and 702. That is, the oil fed out of the suction chamber 715 of the left scavenge pump 701, and the oil fed out of the suction chamber 725 of the right scavenge pump 702 flow together in the discharge chamber 737, and then are discharged from the discharge port 733.

The discharge port 733 for the scavenge pumps 701 and 702 is fitted to the mounting portion 227*a* formed on the upper wall 227 that covers the relay chamber 205, and the discharge port 733 is coupled to the pipe 98. The oil discharged from the discharge port 733 flows through the pipe 98, and reaches the oil tank 90 (see FIG. 1) to be accumulated in the oil tank 90.

The feed pump 704 includes an inner rotor 741 fixed to the pump driving shaft 709, and an outer rotor 743 retained in the housing 730. In accordance with relative rotation of the inner rotor 741 and the outer rotor 743, the feed pump 704 sucks the oil from a suction port 734 into a suction chamber 745, feeds the oil in the suction chamber 745 into a discharge chamber 747, and discharges the oil in the discharge chamber 747 from a discharge port 736.

The suction port 734 of the feed pump 704 is fitted to the mounting portion 227*b* formed on the upper wall 227 that covers the relay chamber 205, and the suction port 734 is coupled to the pipe 99. The oil accumulated in the oil tank 90 (see FIG. 1) is sucked through the pipe 99 by the feed pump 704.

As illustrated in FIG. 13, rotational power of a crankshaft 27 is transmitted to the pump driving shaft 709. A right extending portion 79 of the crankshaft 27, and the shaft portion 134 rotatably supported in the shaft support hole 27*c* are arranged in the generator chamber 13.

A left end portion of the shaft portion 134 enters the relay chamber 205, and is coupled to a right end portion 709*c* of the pump driving shaft 709 of the pump unit 700. A right end portion of the shaft portion 134 is rotatably coupled to a shaft portion 137 supported by a generator cover 12. A gear 135 is formed on a halfway portion of the shaft portion 134.

A pump chain 18 is wound around a gear 19 formed on the right extending portion 79 of the crankshaft 27, and around the gear 135 formed on the shaft portion 134 coupled to the pump driving shaft 709. With this configuration, the rotational power of the crankshaft 27 is transmitted to the pump driving shaft 709.

Figure 14:
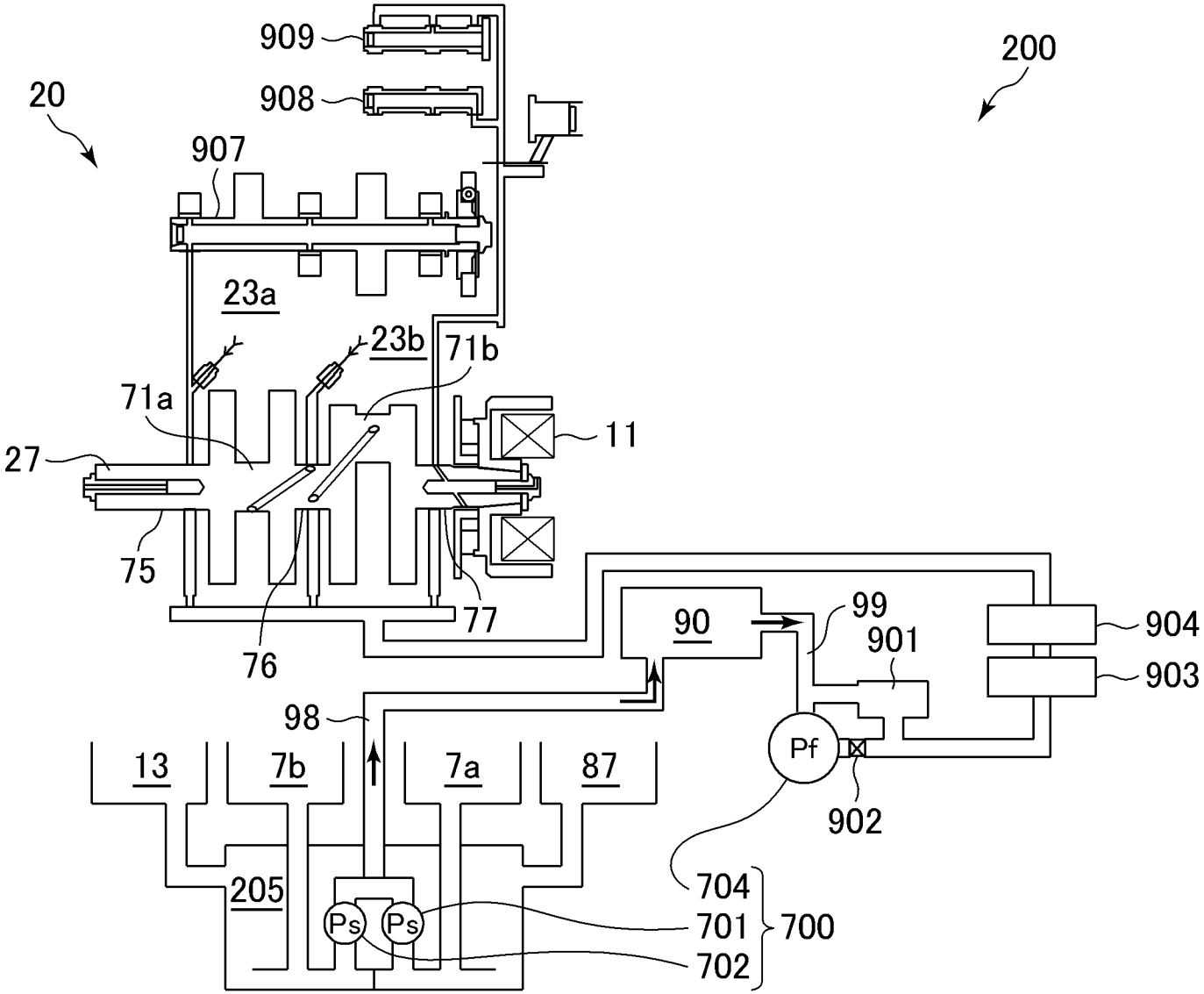
FIG. 14 is a schematic view for illustrating an embodiment of an oil-lubricated path for the engine.
Figure 15:
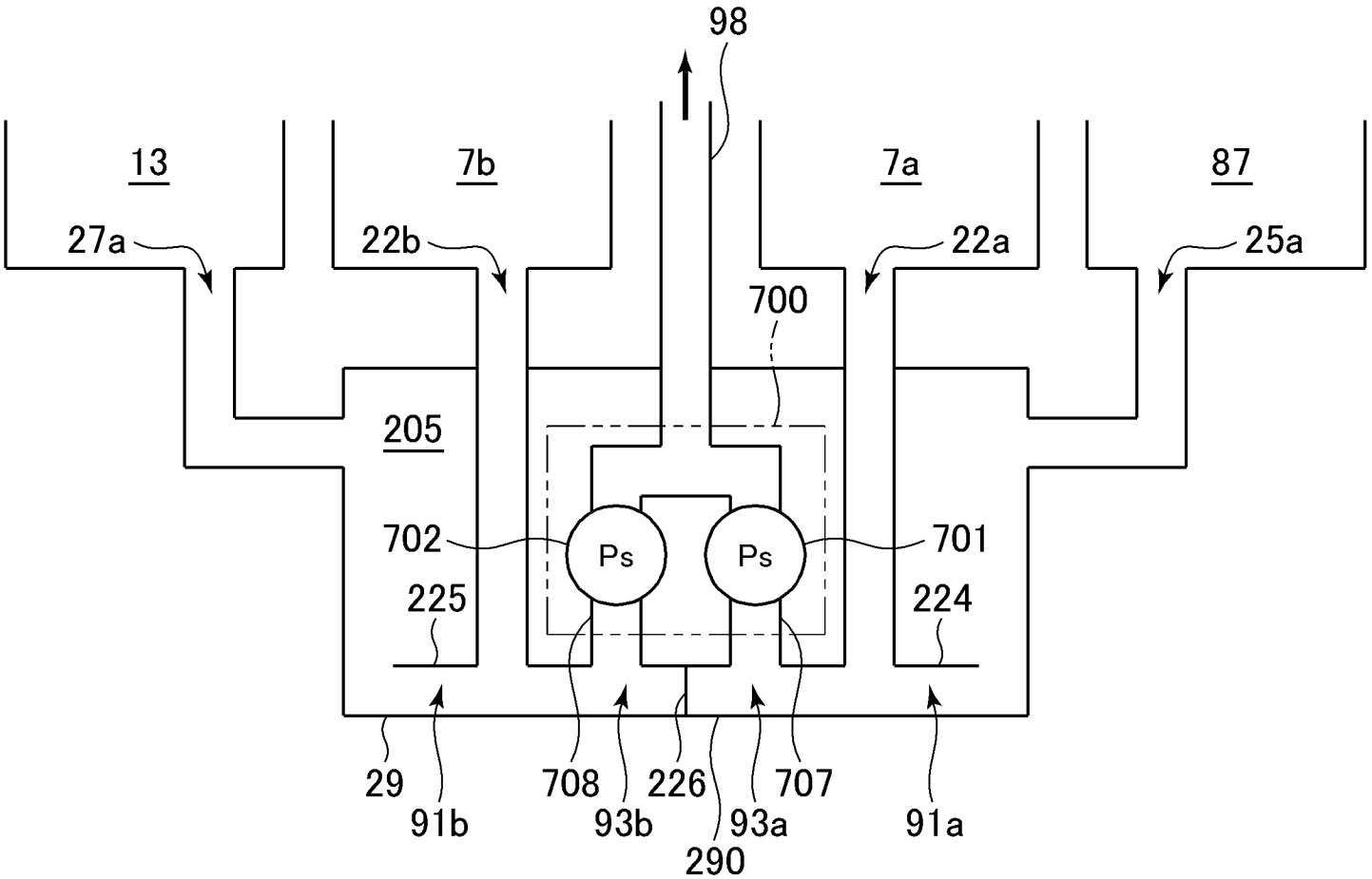
FIG. 15 is an enlarged schematic view for illustrating an embodiment of an oil collecting region in the oil-lubricated path.

FIG. 14 is a schematic view for illustrating an oil-lubricated path for the engine 20 (namely, engine lubrication system 200). FIG. 15 is an enlarged schematic view for illustrating an oil collecting region in the oil-lubricated path for the engine 20.

As illustrated in FIG. 15, the oil in the left crank chamber 7*a* flows through the through-hole 22*a* into the left oil passage 91*a* (first passage) formed by the left passage forming portion 224 and the oil pan 29. The oil flowing into the left oil passage 91*a* further flows into the left oil passage 93*a* (second passage) formed by the oil pan 29 and the cover 290. The oil flowing into the left oil passage 93*a* is sucked through the pipe 707 into the left scavenge pump 701.

Further, the oil in the right crank chamber 7*b* flows through the through-hole 22*b* into the right oil passage 91*b* (first passage) formed by the right passage forming portion 225 and the oil pan 29. The oil flowing into the right oil passage 91*b* further flows into the right oil passage 93*b* (second passage) formed by the oil pan 29 and the cover 290. The oil flowing into the right oil passage 93*b* is sucked through the pipe 708 into the right scavenge pump 702.

Further, the oil in the clutch chamber 87 flows into the relay chamber 205 through the through-hole 25*a*. The oil flowing into the relay chamber 205 through the through-hole 25*a* is mostly sucked into the left oil passage 91*a* (first passage), and then is sucked from the left oil passage 93*a* (second passage) through the pipe 707 into the left scavenge pump 701. The oil flowing into the relay chamber 205 through the through-hole 25*a* may be sucked into the right oil passage 91*b*.

Further, the oil in the generator chamber 13 flows into the relay chamber 205 through the through-hole 27*a*. The oil flowing into the relay chamber 205 through the through-hole 27*a* is mostly sucked into the right oil passage 91*b* (first passage), and then is sucked from the right oil passage 93*b* (second passage) through the pipe 708 into the right scavenge pump 702. The oil flowing into the relay chamber 205 through the through-hole 27*a* may be sucked into the left oil passage 91*a*.

Figure 16:
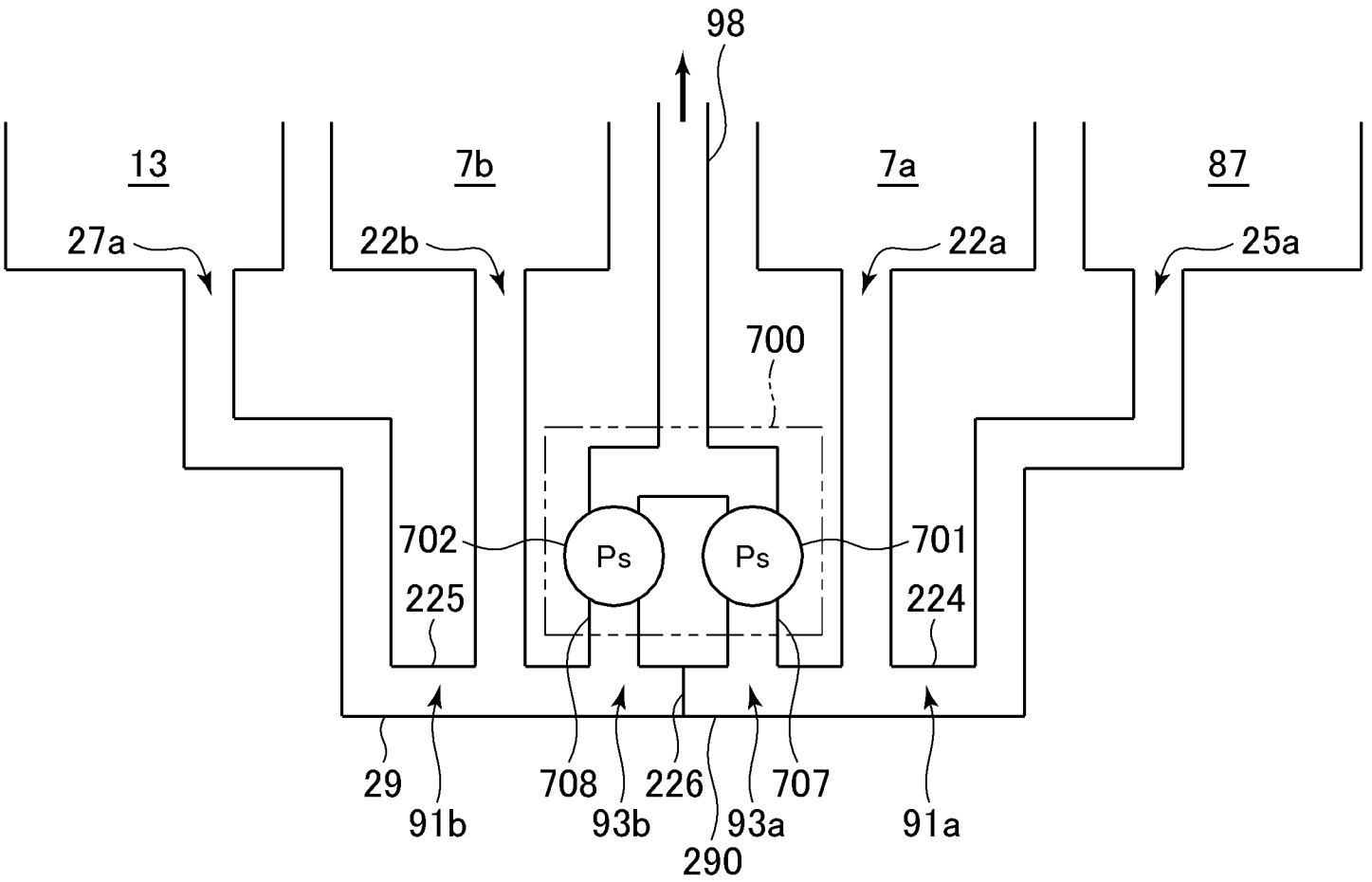
FIG. 16 is a schematic view for illustrating a modified example of the oil collecting region.

The present invention is not limited to this configuration. For example, as illustrated in FIG. 16, the through-hole 25*a* of the clutch chamber 87 and the left oil passage 91*a* may be connected to each other so that the oil in the clutch chamber 87 flows directly into the left oil passage 91*a*. Alternatively, the through-hole 27*a* of the generator chamber 13 and the right oil passage 91*b* may be connected to each other so that the oil in the generator chamber 13 flows directly into the right oil passage 91*b*.

As illustrated in FIG. 14, the scavenge pumps 701 and 702 suck the oil, and feed the sucked oil through the pipe 98 into the oil tank 90 arranged outside the engine 20.

Meanwhile, the feed pump 704 sucks the oil accumulated in the oil tank 90. A relief valve 901 is arranged in parallel to the feed pump 704, and a check valve 902 is arranged downstream of the feed pump 704. The oil discharged from the feed pump 704 passes through an oil cleaner 903 and an oil cooler 904, and then is fed into components of the engine 20.

Specifically, the oil discharged from the feed pump 704 is supplied to crank journals 75 to 77 of the crankshaft 27, and is supplied to crankpins 71*a* and 71*b* arranged in the crank chambers 7*a* and 7*b*, cylinder bores 23*a* and 23*b*, a balancer shaft 907, camshafts 908 and 909, and the like. In addition, the oil is supplied to a generator 11 arranged in the generator chamber 13, and to a centrifugal clutch 80 arranged in the clutch chamber 87.

As described above, in this embodiment, at least a portion of each of the oil passages 91*a* and 91*b* is formed by the lower crankcase 21B, and the oil is directly sucked from the oil passages 91*a* and 91*b* that allow inflow of the oil in the crank chambers 7*a* and 7*b*. Thus, an oil collection efficiency can be increased.

Further, in this embodiment, the pump unit 700 is accommodated in crankcase 21. Thus, the pump unit 700 can be protected from a flying object such as a stone. Further, as compared to a case of arranging the pump unit 700 outside the crankcase 21, path lengths from the crank chambers 7*a* and 7*b* to the scavenge pumps 701 and 702 are reduced. Accordingly, suction resistance can be reduced, and the oil collection efficiency can be increased.

Further, in this embodiment, the oil flowing from the clutch chamber 87 and the generator chamber 13 into the relay chamber 205 further flows into the oil passages 91*a* and 91*b*. Accordingly, the oil collection efficiency can be further increased.

Further, in this embodiment, the pump unit 700 is accommodated or positioned in the relay chamber 205. In general, when priority is given to sealing performance to prevent leakage of the oil, it is necessary to increase a size of the pump. However, in this embodiment, the pump unit 700 is accommodated in the relay chamber 205 so that leakage of the oil can be somewhat permitted. Accordingly, the pump unit 700 can be downsized.

Further, in this embodiment, the scavenge pumps 701 and 702 and the feed pump 704 are included in the pump unit 700. Also with this configuration, the pump unit 700 can be downsized.

Further, in this embodiment, the scavenge pumps 701 and 702 and the feed pump 704 are driven by the common pump driving shaft 709. Also with this configuration, the pump unit 700 can be downsized.

Further, in this embodiment, the two crank chambers 7*a* and 7*b* corresponding to two cylinders, and the two oil passages 91*a* and 91*b* corresponding to the two crank chambers 7*a* and 7*b* are formed. With this configuration, there can be suppressed an influence of an air pressure difference between the crank chambers 7*a* and 7*b* resulting from a phase difference between pistons 24. Further, the path lengths from the crank chambers 7*a* and 7*b* to the scavenge pumps 701 and 702 can be reduced.

Further, in this embodiment, the two scavenge pumps 701 and 702 corresponding to the two oil passages 91*a* and 91*b* are arranged. With this configuration, there can be suppressed the influence of the air pressure difference between the crank chambers 7*a* and 7*b* resulting from the phase difference between the pistons 24. The present invention is not limited to this configuration. The oil passages 91*a* and 91*b* may be formed integrally with each other, or one scavenge pump may be used in place of the scavenge pumps 701 and 702.

Further, in this embodiment, the oil passages 91*a* and 91*b* are formed by the lower crankcase 21B and the oil pan 29 mounted to the lower surface of the lower crankcase 21B. With this configuration, the oil passages 91*a* and 91*b* can be formed at lower positions.

Further, in this embodiment, there are provided the oil passages 91*a* and 91*b* formed by the lower crankcase 21B and the oil pan 29, and the oil passages 93*a* and 93*b* formed by the oil pan 29 and the cover 290 and coupled to the downstream sides of the oil passages 91*a* and 91*b*, respectively. With this configuration, maintenance can be performed on the oil passages 91*a*, 91*b*, 93*a*, and 93*b* only by dismounting the cover 290 from the oil pan 29.

Further, in this embodiment, the scavenge pumps 701 and 702 suck the oil from the oil passages 93*a* and 93*b*. Thus, the scavenge pumps 701 and 702 suck the oil from a position lower than the oil passages 91*a* and 91*b* formed upstream of the oil passages 93*a* and 93*b*. Accordingly, the oil collection efficiency can be increased.

Further, in this embodiment, the pipe 707 is arranged to connect the oil passage 93*a* and the scavenge pump 701 to each other, and the pipe 708 is arranged to connect the oil passage 93*b* and the scavenge pump 702 to each other. With this configuration, the oil is directly sucked from the oil passages 93*a* and 93*b*. Accordingly, the oil collection efficiency can be increased.

Further, in this embodiment, the strainer 92 is arranged to cover the through-holes 29*a* to 29*d* formed in the oil pan 29.

With this configuration, debris clogging the strainer 92 can be removed only by dismounting the cover 290 from the oil pan 29.

Further, in this embodiment, at least a part of the engine 20 is located between front row seats 110 in plan view, and is located below the front row seats 110 in side view (see FIG. 1 and FIG. 2). In the illustrated example, the crankcase 21 of the engine 20 is located between the front row seats 110 in plan view, and is located below the front row seats 110 in side view. Specifically, the crankcase 21 is located below a center console 119 arranged between the front row seats 110. Further, the crankcase 21 is located below seat portions 111 of the front row seats 110. In this embodiment, the engine 20 is a dry sump type engine, and the engine 20 can be downsized by providing the oil tank 90 separately. Accordingly, even in a layout in which at least a part of the engine 20 is located between the front row seats 110 in plan view and located below the front row seats 110 in side view, a minimum ground clearance of a vehicle 100 is easily ensured.

Further, in this embodiment, the scavenge pumps 701 and 702 and the feed pump 704 are accommodated in the engine 20. With this configuration, as described above, the scavenge pumps 701 and 702 and the feed pump 704 can be protected and downsized. As a result, the engine 20 can be also downsized. Therefore, even in the layout in which at least a part of the engine 20 is located between the front row seats 110 in plan view and located below the front row seats 110 in side view, the minimum ground clearance of the vehicle 100 is easily ensured.

Further, in this embodiment, the engine 20 is arranged astride a center of the vehicle 100 in the right-and-left direction of the vehicle (see FIG. 2). The center of the vehicle 100 in the right-and-left direction of the vehicle is located, for example, between the front row seats 110. Further, the engine 20 may be arranged astride a center of the vehicle 100 in the fore-and-aft direction of the vehicle (see FIG. 1). The center of the vehicle 100 in the fore-and-aft direction of the vehicle is located, for example, between front wheels 120 and rear wheels 130. The center console 119 is arranged between the front row seats 110 and between the front wheels 120 and the rear wheels 130, and the engine 20 is arranged below the center console 119. With this configuration, even when the crankcase 21 includes an upward projecting portion or a structure such as an intake pipe is arranged above the engine, the upward projecting portion or the structure can be avoided by modifying a shape of a lower surface of the center console 119.

Further, in this embodiment, the oil tank 90 is arranged at a side of the engine 20 (see FIG. 1). Herein, the "side" means a side in a horizontal direction, and encompasses not only a side in the right-and-left direction but also a side in the fore-and-aft direction. In the illustrated example, the oil tank 90 is arranged behind the engine 20. Alternatively, the oil tank 90 may be arranged in front of the engine 20. When the oil tank 90 is thus arranged at the side of the engine 20, a length in the up-and-down direction of the entire lubrication system including the engine 20 and the oil tank 90 can be reduced. Thus, the minimum ground clearance is easily secured and a projection into a cabin space can be prevented. In addition, when the oil tank 90 is arranged in front of or behind the engine 20, a width in the right-and-left direction of the entire lubrication system including the engine 20 and the oil tank 90 can be also reduced. Accordingly, the lubrication system can be arranged in a vicinity of the center of the vehicle 100 in the right-and-left direction.

Further, in this embodiment, the engine 20 is the dry sump type engine, and the engine 20 can be downsized by providing the oil tank 90 separately. Accordingly, even when the engine 20 is a parallel two-cylinder engine, upsizing of the engine 20 can be prevented.

Although the present invention has been illustrated and described herein with reference to embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An engine lubrication system, comprising:

an oil passage at least partially formed by a crankcase of an engine, said oil passage configured to receive an inflow of oil from a crank chamber partitioned off in the crankcase;

a scavenge pump accommodated in the crankcase and configured to suck the oil from the oil passage;

an oil tank configured to receive the oil sucked by the scavenge pump, said oil tank being separate from the engine and being connected to the engine with a pipe; and an oil feed pump configured to feed the oil accumulated in the oil tank to the engine;

a relay chamber wherein the scavenge pump sucks the oil directly from the relay chamber;

wherein oil flows directly from the crank chamber to the relay chamber; and wherein the relay chamber is located within the crankcase.

2. The engine lubrication system according to claim 1, further comprising:

a generator chamber, which is partitioned off in the engine, and is configured to accommodate a generator therein, wherein the oil passage is configured to receive an inflow of the oil from the generator chamber.

3. The engine lubrication system according to claim 1, further comprising:

a clutch chamber, which is partitioned off in the engine, and is configured to accommodate a centrifugal clutch therein, wherein the oil passage is configured to receive an inflow of the oil from the clutch chamber.

4. The engine lubrication system according to claim 1, further comprising:

a generator chamber, which is partitioned off in the engine, and is configured to accommodate a generator therein; and the relay chamber, which is partitioned off in the engine, and is configured to receive an inflow of the oil from the generator chamber, wherein the oil passage is configured to receive an inflow of the oil from the relay chamber.

5. The engine lubrication system according to claim 4, wherein the scavenge pump is located in the relay chamber.

6. The engine lubrication system according to claim 1, further comprising:

a clutch chamber, which is partitioned off in the engine, and is configured to accommodate a centrifugal clutch therein; and the relay chamber, which is partitioned off in the engine, and is configured to receive an inflow of the oil from the clutch chamber, wherein the oil passage also is configured to receive an inflow of the oil from the relay chamber.

7. The engine lubrication system according to claim 1, further comprising:

a generator chamber, which is partitioned off in the engine, and is configured to accommodate a generator therein;

a clutch chamber, which is partitioned off in the engine, and is configured to accommodate a centrifugal clutch therein; and the relay chamber, which is partitioned off in the engine, and is configured to receive an inflow of the oil from the generator chamber and an inflow of the oil from the clutch chamber, wherein the oil passage is configured to receive an inflow of the oil from the relay chamber.

8. The engine lubrication system according to claim 1, further comprising a pump unit, said pump unit comprising the scavenge pump and the feed pump.

9. The engine lubrication system according to claim 1, further comprising a common shaft, wherein the scavenge pump and the feed pump are driven by the common shaft.

10. The engine lubrication system according to claim 1, wherein the crank chamber comprises a plurality of crank chambers corresponding to a plurality of cylinders of the engine, and wherein the oil passage comprises a plurality of oil passages corresponding to the plurality of crank chambers.

11. The engine lubrication system according to claim 10, wherein the scavenge pump comprises a plurality of scavenge pumps corresponding to the plurality of oil passages.

12. The engine lubrication system according to claim 1, further comprising an oil pan mounted to a lower surface of the crankcase, wherein at least a portion of the oil passage is formed by the crankcase and the oil pan.

13. The engine lubrication system according to claim 1, wherein the oil passage comprises:

a first passage, which is formed by the crankcase and an oil pan mounted to a lower surface of the crankcase; and a second passage, which is formed by the oil pan and a cover configured to cover an opening formed in the oil pan, wherein the second passage is coupled to a downstream side of the first passage.

14. The engine lubrication system according to claim 13, wherein the scavenge pump is configured to suck the oil from the second passage.

15. The engine lubrication system according to claim 14, further comprising a pipe configured to connect the second passage to the scavenge pump.

16. The engine lubrication system according to claim 13, further comprising a strainer configured to cover the opening of the oil pan.

17. The engine lubrication system according to claim 1, wherein a part of said oil passage is formed by a passage forming portion formed on a lower surface of the crankcase to be open toward an oil pan and the oil passage is formed by joining the oil pan therewith.

18. An engine, comprising:

a crankcase;

an oil passage at least partially formed by a passage forming portion formed on a lower surface of the crankcase to be open toward an oil pan and the oil passage is formed by joining the oil pan therewith, said oil passage designed to receive an inflow of oil from a crank chamber partitioned off in the crankcase; and a scavenge pump, which is located in the crankcase, and is configured to suck the oil from the oil passage and to supply the sucked oil to an oil tank, a relay chamber wherein the scavenge pump sucks the oil directly from the relay chamber;

wherein oil flows directly from the crank chamber to the relay chamber; and wherein the relay chamber is integrated into the crankcase.

19. A vehicle, comprising:

an engine comprising an oil passage at least partially formed by a crankcase, said oil passage designed to receive an inflow of oil from a crank chamber partitioned off in a crankcase;

a scavenge pump configured to suck the oil from the oil passage;

an oil tank, which is arranged outside the engine, and is configured to accumulate the oil sucked by the scavenge pump, said oil tank being separate from the engine and being connected to the engine with a pipe;

a feed pump configured to supply, to the engine, the oil accumulated in the oil tank; and a plurality of seats aligned in a right-and-left direction of the vehicle, wherein at least a portion of the engine is located between the plurality of seats in plan view, and is located below the plurality of seats in side view, a relay chamber wherein the scavenge pump sucks the oil directly from the relay chamber;

wherein oil flows directly from the crank chamber to the relay chamber; and wherein the relay chamber is located within the crankcase.

20. The vehicle according to claim 19, wherein the scavenge pump and the feed pump are accommodated in the engine.

21. The vehicle according to claim 19, wherein the engine is arranged astride a center of the vehicle in the right-and-left direction of the vehicle.

22. The vehicle according to claim 19, wherein the oil tank is arranged at a side of the engine.

23. The vehicle according to claim 22, wherein the oil tank is positioned either behind the engine or in front of the engine.

24. The vehicle according to claim 19, wherein the engine comprises a parallel two-cylinder engine.

* * * * *